US006253924B1

(12) United States Patent
Bleifuss et al.

(10) Patent No.: US 6,253,924 B1
(45) Date of Patent: Jul. 3, 2001

(54) MAGNETIC SEPARATOR APPARATUS AND METHODS REGARDING SAME

(75) Inventors: Rodney L. Bleifuss, Grand Rapids; David M. Hopstock, Roseville, both of MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 09/188,975

(22) Filed: Nov. 10, 1998

(51) Int. Cl.[7] ..... B03C 1/00

(52) U.S. Cl. ..... 209/223.1; 209/225; 209/215; 198/821

(58) Field of Search ..... 209/223.1, 213, 209/214, 225, 226, 227, 228, 231, 636, 233.2, 232; 198/690.2, 690.1, 848

(56) References Cited

U.S. PATENT DOCUMENTS

| | | | | |
|---|---|---|---|---|
| 3,947,349 | | 3/1976 | Fritz . | |
| 4,046,680 | | 9/1977 | Fritz . | |
| 4,109,784 | | 8/1978 | Hartmann . | |
| 4,260,477 | | 4/1981 | Corrans . | |
| 4,729,827 | | 3/1988 | Corrans et al. . | |
| 4,874,508 | | 10/1989 | Fritz . | |
| 6,056,879 | * | 5/2000 | Schaaf et al. | 210/695 |
| 6,086,761 | * | 7/2000 | Green | 210/222 |

OTHER PUBLICATIONS

Mintek, Randburg, South Africa, "Magnetic Separator," (1 p.) (undated).
R. H. Richards, "Miscellaneous Processes of Separation," Chapter XVIII, II, *Ore Dressing* , 790–815, (1908).
A. F. Taggart, "Electrical Concentration," Section 13, *Handbook of Mineral Dressing* , 13–01–13–21 (1945).
N. L. Weiss, "Electrostatic and Magnetic Separation," 1, *SME Mineral Processing Handbook* , 6–36–6–38 (1985).

* cited by examiner

*Primary Examiner*—Donald P. Walsh
*Assistant Examiner*—David A Jones
(74) *Attorney, Agent, or Firm*—Mueting, Raasch & Gebhardt, P.A.

(57) ABSTRACT

A magnetic separator apparatus for use in separating magnetic material from a mixture of at least magnetic material and a liquid includes an endless belt defining a channel. A portion of the endless belt is movable up an incline relative to horizontal through a separation zone. The endless belt includes an endless base section having a predetermined length and first and second sidewalls extending from the endless base section along the entire predetermined length thereof. The endless base section and the first and second sidewalls define the channel wherein the mixture is received. Further, the apparatus includes a ferromagnetic collection matrix positioned in the channel and one or more magnets positioned for generating a magnetic field in the separation zone. A method for use in separating magnetic material from a mixture using such an apparatus is also provided.

14 Claims, 14 Drawing Sheets

MAGNETIC SEPARATOR APPARATUS AND METHODS REGARDING SAME

FIELD OF THE INVENTION

The present invention relates to the separation of magnetic material from non-magnetic material, e.g., magnetic material from ore slurries, magnetic material from liquids, etc. More particularly, the present invention pertains to wet magnetic separation of such materials.

BACKGROUND OF THE INVENTION

Magnetic separation utilizes the force of a magnetic field co-acting with some other force to produce differential movements of material through the field. Fundamentally, differences in magnetic permeability of material constitute the basis for separation, but such separation is influenced by mechanical attributes of the separator used. Generally, magnetic permeability refers to the measure of the ease with which magnetic properties may be induced by the action of a magnetic field. Mixtures susceptible to magnetic separation are generally those which include materials that fall into different classifications, e.g., strongly magnetic and weakly magnetic materials versus non-magnetic materials. As used herein, the term "magnetic" refers to material which is magnetically susceptible, and is not meant to necessarily imply material which may be permanently magnetized.

Magnetic separation is typically used in association with iron mining operations. For example, in instances where the iron ore is of relatively low grade and contains a large quantity of extraneous rock material, or gangue, magnetic separation may be used to separate the iron ores from the gangue or other heavy minerals of a slurry. An example of such an operation is the separation of magnetite from taconite. Such separation may even be performed on tailings from mining operations which may be a valuable source of iron.

Separation of solids according to their magnetic properties is known, and various apparatus are described for performing such a separation function. For example, the Conklin wet magnetic separator is described in the book entitled, *Ore Dressing,* by R. H. Richards, Vol. II, 2nd Ed., Section 591, p. 810, McGraw-Hill Book Co. (1908). The Conklin wet magnetic separator is described as including a distributing belt placed on an incline. Magnets for providing a magnetic field are placed beneath the belt. In other words, the belt is on an incline and the magnets are placed beneath the belt between an ascending and descending side of the belt. Ore is fed upon the belt near the magnets generating the magnetic field. A stream of water runs down the belt and carries the non-magnetic material off at the lower end of the belt, while the magnetic particles are held against the belt by attraction resulting from the magnetic field. The magnetic particles are carried by the belt as it moves up the incline and are discharged as the belt starts to decline at an upper end thereof.

In addition, a Roche wet belt machine is described in the book entitled, *Handbook of Mineral Dressing,* by A. F. Taggart, Sect. 13–20, John Wiley & Sons, Inc., New York (1945). The Roche wet belt machine operates in a manner similar to the Conklin wet magnetic separator. The Roche wet belt machine consists of an endless rubber vanner belt set on a slope of 10° to 80°. A battery of electromagnets having alternating poles of opposite polarity are enclosed in a box and positioned underneath the upper run of the belt which is held at the incline. Feed, e.g., magnetic material and non-magnetic material, is introduced at a lower portion of the inclined belt and magnetic material is held against the belt by the action of the magnets positioned thereunder. The magnetic material is carried up the slope of the belt against a stream of wash water supplied at an upper end of the belt. The nonmagnetic material, acted on by the wash water and gravity, flows down the slope and discharges over the lower end of the belt. Washing of the concentrate is aided by the winnowing motion caused by the alternating polarity of the magnet poles of the magnets positioned underneath the belt.

Both the Conklin and Roche wet magnetic separators generally collect a thin layer of magnetic material on the generally flat inclined belt thereof. Such a thin layer of magnetic material being captured is generally inefficient with regard to throughput for the feed or mixture to be separated. In both the Conklin and Roche wet magnetic separators, the collected magnetic material tends to collect over the upper-most magnet positioned underneath the inclined belt. The magnetic material tends to remain stationary at this position because the magnetic material tends to slide backwards on the belt as the belt travels up the incline beneath it. As such, erratic discharge of the collected magnetic material over the upper edge of the inclined belt results. In other words, such problems lead to a non-uniform discharge as the inclined belt passes over the upper edge of the magnetic separator. This non-uniform discharge in turn interferes with efficient operation of the magnetic separator.

Use of a ferromagnetic matrix to assist magnetic separation has also been described. For example, in the publication, *Handbook of Mineral Dressing,* by Taggart, Sect. 13–21, the Frantz Ferro-filter is described. The Frantz Ferro-filter uses a set of magnetic screens to assist in separation. Further, also described in the *Handbook of Mineral Dressing* by Taggart, Sect. 13–21, is a magnetic trough separator which uses rectangular auxiliary pole pieces to assist in magnetic separation. The magnetic trough separator includes a battery of magnets housed in a waterproof copper casing over which a removable tray is placed. The removable tray has a bottom studded with the rectangular auxiliary pole pieces; the pole pieces appropriately staggered. The tray is shown at an incline and pulp is fed from a pipe into the removable tray such that the pulp flows downhill and discharges into a suitable launder. During its downhill run, the pulp is subjected to the magnetic field induced in the auxiliary pole pieces with magnetic contaminants being attracted and held to the auxiliary pole pieces. The magnetic field is then cycled off and the removable tray is removed from the separator to remove the magnetic contaminants therefrom and the tray is then repositioned in the separator. For example, the separator may be used for removal of small amounts of magnetic material from clay, silt, and the like.

The Frantz Ferro-filter and the magnetic trough separator both have problems associated therewith. For example, neither of such apparatus provide means of continuously discharging collected magnetic material. To remove the magnetic material from such apparatus, the flow of the feed slurry or mixture must be interrupted. For example, the electromagnets used to magnetize the magnetic screens in the Frantz Ferro-filter must be cycled off to remove the collected material and the tray of the trough separator must be removed to obtain the collected magnetic material. Such cyclic operation is generally impractical. Particularly, such cyclic operation becomes impractical when the feed or mixture being separated contains more than a very small percentage of magnetic material. In other words, if a large percentage of magnetic material is being captured, the separators must be interrupted constantly to remove such collected magnetic material.

Continuous collection and discharge of magnetic material from a matrix in a magnetic separator is described with reference to the Jones separator in the *SME Mineral Processing Handbook,* by N. L. Weiss, Vol. 1, pp. 6-36 to 6-38, SME (1985). The Jones separator, and other similar machines, is made continuous by using the basic design of a Forsgren separator in which the slurry enters a high magnetic field region between magnet pole pieces in a rotating annular ring containing a high gradient collecting matrix for attracting magnetic material of the slurry provided thereto. The annular ring is generally held in a horizontal position. The non-magnetic material passes quickly through the matrix and the magnetic material is removed when the ring moves out of the high magnetic field region between the magnet pole pieces. Such an apparatus may be referred to as rotating annular ring or "Carousel" design.

In such Carousel designs, slurry and wash water flow is approximately perpendicular to the travel direction of the annular ring which rotates in a horizontal plane. The rotation of the collection matrix in the annular ring physically diverts the flow of slurry in the direction of matrix travel. As the rotation rate of the annular ring increases, an undesirable increasing percentage of the non-magnetic material in the feed or slurry is diverted into the launders which are supposed to collect only magnetic material flushed off the collection matrix by wash water. Further, another undesirable effect encountered with the Carousel designs is permanent entrapment of particles within the ferromagnetic matrix. This is particularly problematic with regard to strongly ferromagnetic and oversized particles. In other words, since the matrix remains fixed in a position within the Carousel design, and further since the dislodgement force that can be applied by spray water is attenuated within the body of the matrix, once particles become strongly entrapped in the matrix, it is very difficult to remove them. As trapped magnetic particles build up in the matrix, the capacity and performance of the machine deteriorates. Eventually, the only solution is the very costly step of shutting down the machine, disassembling the matrix, and cleaning it.

Generally, Carousel-type machines use electromagnets to generate the desired magnetic fields. A modified Carousel apparatus using permanent magnets is described in U.S. Pat. No. 3,947,349 to Fritz, entitled "Permanent Magnet High Intensity Separator," issued Mar. 30, 1976; U.S. Pat. No. 4,046,680 to Fritz, entitled "Permanent Magnet High Intensity Separator," issued Sep. 6, 1977; and U.S. Pat. No. 4,874,508 to Fritz, entitled "Magnetic Separator," issued Oct. 17, 1989. The original described Fritz separator apparatus incorporates various changes from the conventional Carousel design, several of which tend to reduce the problem of matrix entrapment or clogging as described above. In the Fritz apparatus, the axis of the rotating cylinder is set horizontally, causing the annular rings and matrix thereof to rotate in a vertical plane as opposed to rotating in a horizontal plane as described above. The direction the slurry flow is then vertical in the plane of the ring. Further, instead of a single ring, Fritz describes the use of a series of side-by-side rings separated by regions containing permanent magnets and vibration is applied to assist in dislodgement of trapped particles.

As in conventional Carousel-type designs, the slurry flow in the Fritz apparatus is in the downward direction and approximately at a right angles to the matrix travel of the apparatus. The magnetic material is flushed off the matrix after the ring has rotated approximately 180° from the feed or slurry inlet. Because flush water flow is also downwards, the matrix is subjected to a back flush action which is beneficial for removing matrix entrapped particles that were trapped simply because they were too large to pass through openings in the ferromagnetic matrix. However, the Fritz machines, despite the vibration and the back flush action, do not adequately reduce the matrix clogging problem.

In U.S. Pat. No. 4,874,508 to Fritz, such matrix clogging is further addressed by providing flexible race walls which are deformed to expand and recompress the matrix to facilitate separation of magnetic material from nonmagnetic material. For example, deformation of the race walls is accomplished by a cam mechanism. The complex design of the Fritz machine leads to generally high construction costs. Particularly, such costs increase as the magnetic separator is scaled up to larger commercial sizes. For example, the construction cost per foot of width for the magnetic separator of Fritz remains essentially the same as the width is increased. In other words, a 10 foot wide unit will cost nearly ten times as much as a 1 foot wide unit. This is because most of the elements in the 1 foot unit must be duplicated ten times to make a 10 foot unit. As such, complexity in design is a particularly undesirable aspect of magnetic separators.

SUMMARY OF THE INVENTION

Therefore, there is a need for magnetic separators which overcome the disadvantages and/or problems described above with respect to conventional magnetic separators. Further, the need for methods of magnetic separation overcoming such disadvantages and/or problems is also desired.

A magnetic separator apparatus according to the present invention for use in separating magnetic material from a mixture of at least magnetic material and a liquid includes an endless belt defining a channel. At least a portion of the endless belt is movable up an incline relative to horizontal through a separation zone. The endless belt includes an endless base section having a predetermined length and first and second sidewalls extending from the endless base section along the entire predetermined length thereof. The endless base section and the first and second sidewalls define the channel wherein the mixture is received. Further, the apparatus includes a ferromagnetic collection matrix positioned in the channel and one or more magnets positioned for generating a magnetic field in the separation zone.

In one embodiment of the apparatus, the apparatus further includes a first and second roller positioned with a fixed distance therebetween. Each of the first and second rollers has a longitudinal axis therethrough. One of the first and second rollers is positioned at a first distance above horizontal and the other is positioned above horizontal at a second distance which is greater than the first distance. Further, the endless belt is positioned for movement about the first and second rollers up the incline in a direction perpendicular to the longitudinal axes of the first and second rollers.

In another embodiment of apparatus, the first and second sidewalls of the endless belt extend from the base section of the endless belt a predetermined distance measured perpendicularly from the base section to a distal end of the first and second sidewalls. Preferably, the predetermined distance is greater than about 4 inches.

In another embodiment of the apparatus, the ferromagnetic collection matrix includes a plurality of collection matrix elements. Each collection matrix element extends from the base section a vertical distance measured perpendicularly from the base section to a distal end thereof. Preferably, the vertical distance is less than or equal to the predetermined distance which the first and second sidewalls extend from the base section.

In yet another embodiment of the apparatus, the ferromagnetic collection matrix includes a plurality of collection matrix elements provided in a predetermined pattern along the base section of the endless belt. The predetermined pattern is such that the collection matrix elements are in a first state when the collection matrix elements are in a position away from the first and second rollers and are in a second expanded state when proximate the first and second rollers. For example, the plurality of collection matrix elements may be provided by an accordion-like folded collection matrix.

In other embodiments of the apparatus, the one or more magnets may include a plurality of magnets such that regions of alternating magnetic field are created in the separation zone through with the ferromagnetic collection matrix is moved, the one or more magnets may include one or more electromagnets, and/or the one or more magnets may include one or more permanent magnets.

In yet another embodiment of the apparatus, each of the first and second sidewalls include a first proximal end sealed to the base section along the predetermined length and a second distal end. The first and second sidewalls are flexible sidewalls, e.g., corrugated sidewalls, such that the second distal end is expandable to a length that exceeds the predetermined length of the base section.

A method for use in separating magnetic material from a mixture including at least magnetic material and a liquid is also described. The method includes moving a portion of an endless belt between a first element and second element up an incline through a separation zone. The second element is elevated relative to the first element. The endless belt includes an endless base section having a predetermined length and first and second sidewalls extending from the endless base section along the predetermined length thereof. The endless base section and the first and second sidewalls define a channel wherein a ferromagnetic collection matrix is positioned. The mixture including at least magnetic material is received within the channel for flow down the incline. A magnetic field is provided in the separation zone to magnetize the ferromagnetic collection matrix as the ferromagnetic collection matrix moves through the separation zone to attract magnetic material to the ferromagnetic collection matrix. The magnetic material is discharged from the ferromagnetic collection matrix after the endless belt moves out of the separation zone.

In one embodiment of the method, the ferromagnetic collection matrix includes a plurality of collection matrix elements. The plurality of collection matrix elements are provided in a predetermined pattern along the base section of the endless belt. With use of such a predetermined pattern, the discharge of the magnetic material may include fanning open the plurality of collection matrix elements as the collection matrix elements are moved proximate the second element. For example, the predetermined patterned may include two or more rows of matrix elements with adjacent rows having element gaps defined therebetween. Such element gaps are expanded as the collection matrix elements are moved proximate the second element.

In another embodiment of the method, providing the magnetic field includes providing an alternating magnetic field along at least a portion of the separation zone such that attracted magnetic material migrates upon the ferromagnetic collection matrix as the endless belt is moved up the incline.

DETAILED DESCRIPTION OF THE EMBODIMENTS

The present invention shall first be generally described with reference to FIG. 1. Thereafter, various illustrative alternate embodiments of magnetic separator apparatus and magnetic separation methods shall be described in further detail with reference to FIGS. 1–11.

Figure 1:
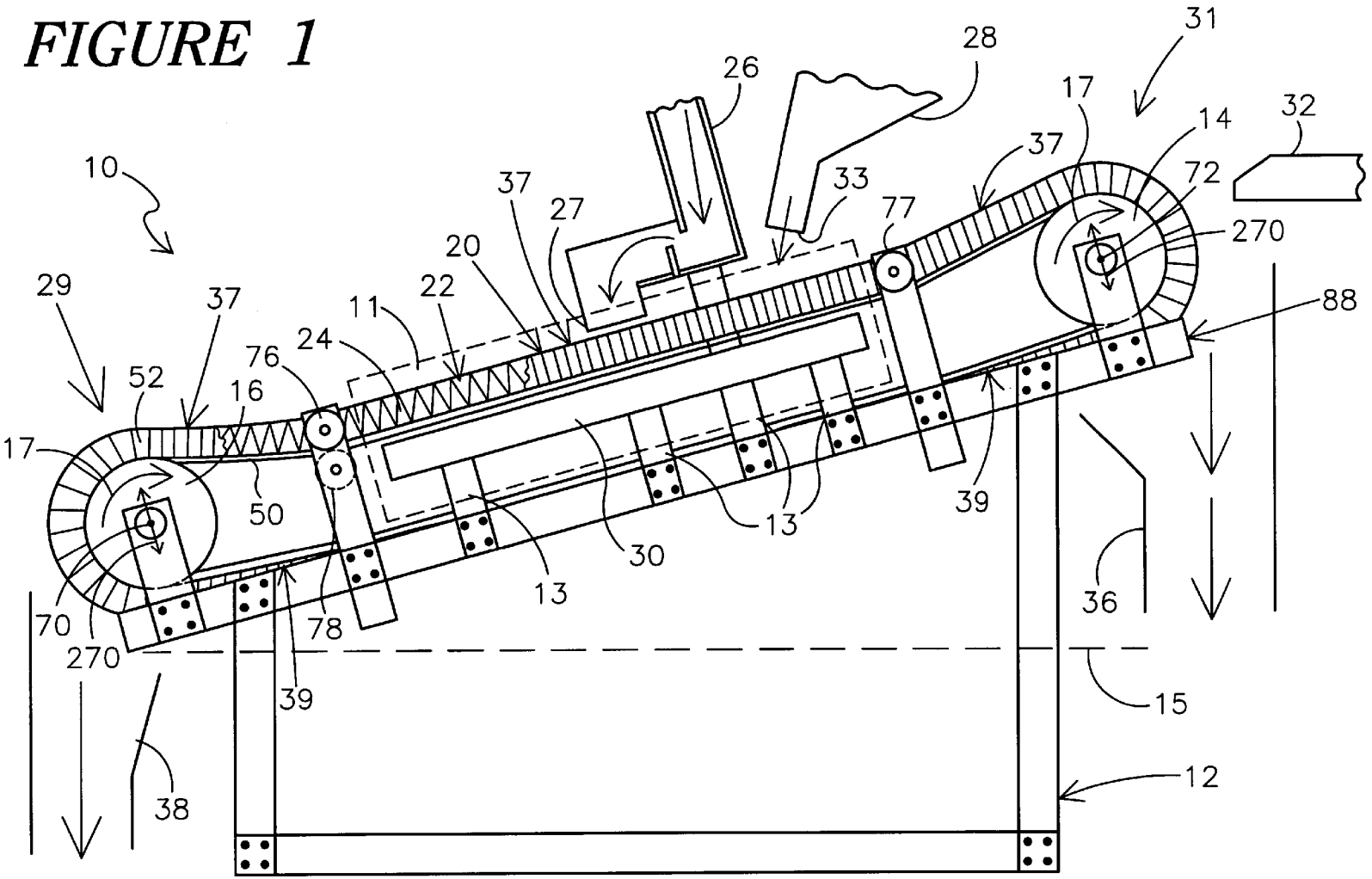
FIG. 1 is a side view of an illustrative magnetic separator apparatus according to the present invention.

Generally, an illustrative magnetic separator apparatus 10 according to the present invention is shown in FIG. 1. The magnetic separator apparatus 10 is a wet magnetic separator apparatus for the separation of magnetic material from nonmagnetic material. For example, the mixture may be a suspension of magnetic material and non-magnetic material, e.g., such material may be suspended in water. Further, for example, the mixture may be magnetic material suspended in a liquid, e.g., metal particles contaminating a liquid. Illustratively, and as used extensively herein, the mixture may be a slurry suspending magnetic material and non-magnetic material, e.g., a slurry of iron ore, tailings, etc. Therefore, as used herein, a mixture separated according to the present invention may be magnetic material suspended in a liquid, or may be magnetic material and non-magnetic material suspended in a liquid, e.g. water.

The mixture is provided to the magnetic separator apparatus 10 and the magnetic separator apparatus 10 is used for the separation of weakly magnetic and/or strongly magnetic materials from the mixture. For example, such recovery may include recovery of magnetite from a taconite slurry. As used herein, magnetic material shall include both weakly magnetic material and strongly magnetic material. Such magnetic material, including weakly magnetic material and strongly magnetic material, is generally defined as material having a relative magnetic permeability greater than about 1.001. Also, as used herein, non-magnetic material is defined as material having a relative magnetic permeability of less than about 1.001.

One skilled in the art will recognize that there are various applications for a magnetic separator apparatus according to the present invention. For example, a magnetic separator apparatus according to the present invention may be used for magnetic scavenging of floatation froths produced during the upgrading of taconite concentrates, may be used for magnetic scavenging of fine taconite tailings streams to recover misplaced magnetic iron units, may be used in the dewatering of fine screen undersized, or oversized, products produced in taconite processing, and may be used in upgrading finely ground taconite. Further, a magnetic separator apparatus according to the present invention may be used in the magnetic scavenging of thickener overflows to recover fine magnetite in taconite circuits and may be used as an alternate magnetic separation apparatus for the recovery of magnetite material or ferrosilicon material, used in coal washing and other heavy media separation plants.

One skilled in the art will recognize from the description herein that the strength of the magnetic field, created in at least the separation zone 11 for the magnetic separator apparatus 10, at least in part determines the types of materials which may be separated, e.g., a strong magnetic field may be needed to recover weakly magnetic material from the non-magnetic material suspended in a mixture. For example, according to the present invention, installing stronger magnets to create a stronger magnetic field may allow the unit to recover weakly magnetic iron minerals from oxidized taconite or beach sands, and further may allow the magnetic separator apparatus 10 to be used for the purification of kaolin, glass sands, feldspar, and other non-magnetic materials by removal of magnetic impurities or contaminants.

Generally, the magnetic separator apparatus 10 according to the present invention includes an endless belt 20. At least a portion of the endless belt 20 is movable up an incline relative to horizontal 15 as shown by the ascending upper run 37 of the endless belt 20 in FIG. 1. Further, generally, the endless belt 20 includes sidewalls 52, 53 (shown in FIG. 2) extending from a base section 50 thereof which define a channel 22 of the endless belt of the magnetic separator apparatus 10. A ferromagnetic collection matrix 24 is positioned in the channel 22 defined by the endless belt 20. The ferromagnetic collection matrix 24 is carried up the incline relative to horizontal 15 through separation zone 11 in which a magnetic field is generated by one or more magnets 30.

The channel 22 receives a mixture, e.g., a suspension of magnetic and nonmagnetic material, from one or more feed and/or liquid sources. For example, as described above, the mixture may be a suspension of magnetic and non-magnetic material, e.g., a slurry of iron ore, provided from feed source 26 via outlet 27 at a position along the upper run 37, i.e., the mixture feed point. Further, for example, the mixture may include magnetic and non-magnetic material provided from feed source 26 and a liquid, e.g., water, provided from liquid source 28 via outlet 33 used to suspend the magnetic and non-magnetic material. In other words, the mixture received in channel 22 may be a suspension provided to the channel 22, e.g., a suspension of magnetic and non-magnetic material, or components thereof which form a suspension in the channel 22. As described above, various suspensions, e.g., mixtures, may be provided to or formed in channel 22 from which magnetic material may be separated according to the present invention. However, hereinafter, for simplicity, the present invention shall be described with reference to a mixture including magnetic material and non-magnetic material suspended in water.

The mixture feed point where the mixture is provided to channel 22 may be at any position along the upper run 37 such that the mixture flows down the ascending upper run 37 of the endless belt 20 through at least a portion of the separation zone 11 as the endless belt 20 is moved up the incline relative to horizontal 15. Further, as the mixture flows down the inclined portion of the endless belt 20, the mixture flows through the ferromagnetic collection matrix 24 positioned in the channel 22. The ferromagnetic collection matrix 24 is energized by the one or more magnets 30 creating the magnetic field in the separation zone 11 as the collection matrix 24 moves through the separation zone 11. In the separation zone 11, magnetic material of the mixture is attracted to and held by the ferromagnetic collection matrix 24. Movement of the upper run 37 of the endless belt carries the collection matrix 24 with the attracted magnetic material beyond the mixture feed point against the flow of the mixture downstream. The ferromagnetic collection matrix 24 with the attracted magnetic material is carried outside of the separation zone 11 and discharged, such as by gravity as the endless belt 20 descends, e.g., discharge may occur at a position along the lower run 39 between the upper region 31 and the lower region 29 of the magnetic separator apparatus 10. Non-magnetic material suspended in the water of the mixture is discharged as it flows down the incline at the lower region 29 of magnetic separator apparatus into non-magnetic material launder 38.

Magnetic material is carried outside of the separation zone 11 by the collection matrix 24 because of the mechanical entrapment thereof aided by the magnetic aggregation of the magnetic material attracted to the collection matrix 24. The discharge of the magnetic material or release of the magnetic material from the collection matrix 24 is assisted as the endless belt 20 moves over an element at the upper region 31, e.g., roller 14, by the fanning open of the collection matrix 24 as will be described in further detail below. Such discharge of the magnetic material may be further assisted by provision of wash water to the fanned open collection matrix 24.

A magnetic separator apparatus according to the present invention provides for the effective treatment of large volumes of mixtures containing low percentages of magnetic material because of the open nature of the apparatus. For example, the essentially open channel allows for the free flow of the mixture through the apparatus. Capture of the magnetic material of the mixture is accomplished through use of the ferromagnetic collection matrix 24 positioned in the channel 22 defined by the sidewalls 52, 53 and endless base section 50 of the endless belt 20. Use of the ferromagnetic collection matrix 24 and the sidewall configuration has various advantages. For example, with a high sidewall, the volumetric flow rate of mixture, e.g., slurry of magnetic and non-magnetic material, and hence the machine capacity, is generally greater relative to conventional apparatus. Even with a higher capacity, the ferromagnetic collection matrix 24 allows the magnetic material of the mixture to be collected in a thinner layer, since it is uniformly distributed over the collection matrix 24 rather than concentrated as a thick bed on the surface of a conventional belt utilized in a conventional belt type magnetic separator. For example, the ferromagnetic collection matrix 24 may multiply the magnetic attraction force created by a given magnetic field in the separation zone 11 by a factor of ten. This allows for use of a much faster mixture flow velocity and more intense washing action without dislodging the magnetic particles attracted to the collection matrix 24 in the separation zone 11. In other words, the flow of the mixture down the upper run 37 of the endless belt 20 as it moves up the incline relative to horizontal 15 may be performed at a much greater velocity. With a more intense washing action and thinner collected magnetic layer on the ferromagnetic collection matrix 24, removal of physically-entrained non-magnetic material is facilitated and the purity or grade of a magnetic product collected and discharged by the magnetic separator apparatus 10 is enhanced.

Magnetic material recovery for a magnetic separator apparatus according to the present invention is efficient because the turbulence of the mixture as it flows down the channel 22 of the endless belt 20 keeps the particles of the mixture in suspension. As such, the magnetic material has multiple opportunities to pass close to the energized ferromagnetic collection matrix 24 in the channel 22 of the endless belt 20 for capture. The counterflow of the feed mixture down the incline, i.e., counter to the movement of the endless belt 20 up the incline relative to horizontal 15, makes it virtually impossible for feed mixture containing non-magnetic particles to be physically diverted to the upper region 31 of the magnetic separator apparatus 10 and undesirably discharged, regardless of the speed of the endless belt 20.

The present invention further provides very effective separation using an apparatus which is particularly simple in design. Because of such simplicity, the magnetic separator apparatus 10 according to the present invention may be constructed at a generally lower cost relative to many conventional machines. Further, such generally lower costs are applicable when the magnetic separator is increased in size as it is scaled up to larger commercial sizes. For example, the construction cost per foot of width for the separator decreases significantly as belt width increases, e.g., a ten foot wide apparatus according to the present invention may only cost a few times as much as a one foot unit.

Figure 2:
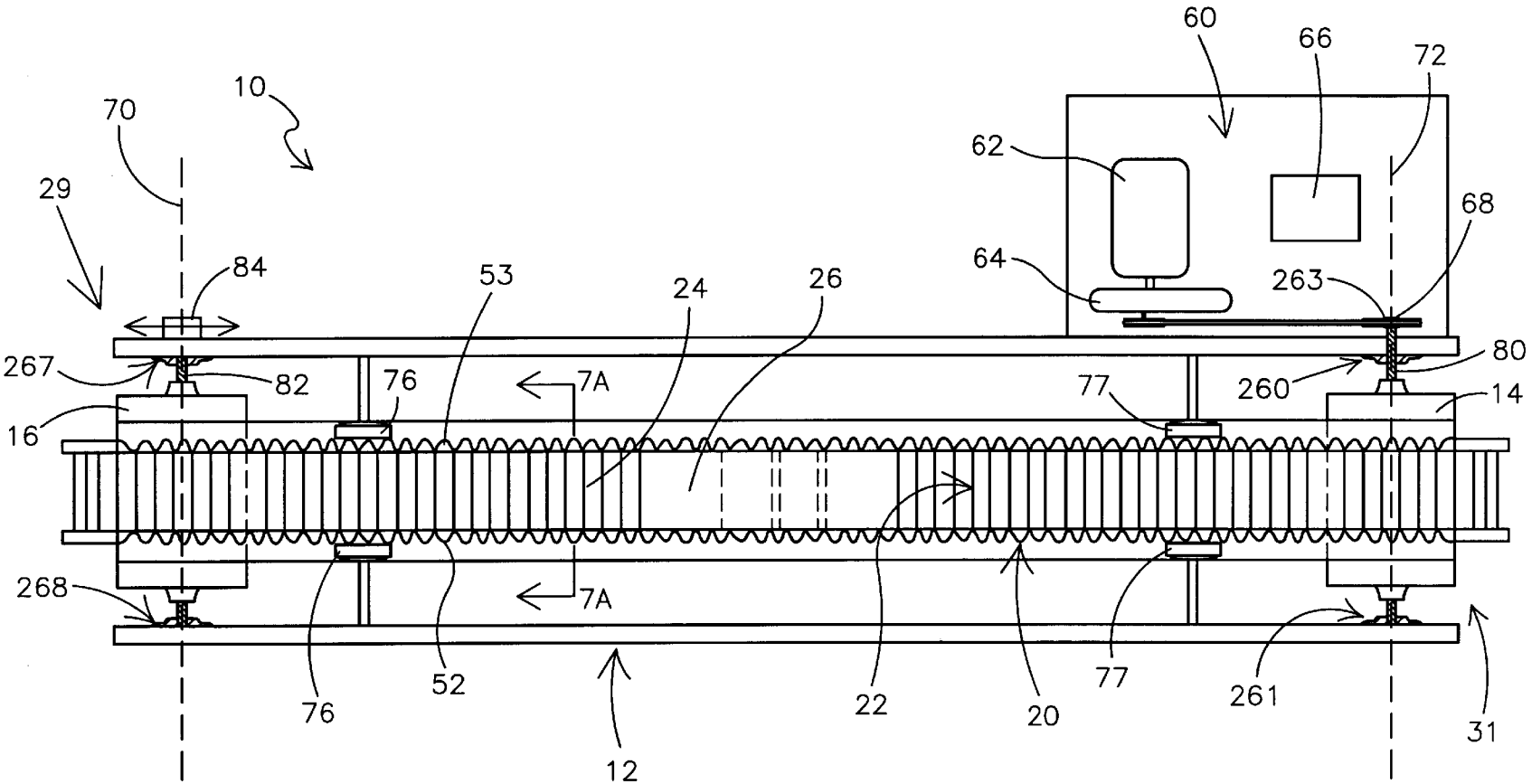
FIG. 2 is a top view of the magnetic separator apparatus shown in FIG. 1.

The present invention shall now be described in further detail with reference to FIGS. 1–11. FIG. 1 shows a side view of the illustrative magnetic separator apparatus 10 according to the present invention. FIG. 2 shows a top elevational view of the magnetic separator apparatus 10. As shown in FIGS. 1 and 2, the magnetic separator apparatus 10 includes a support structure 12 for supporting an endless belt 20. The endless belt 20 includes an upper run 37 movable up an incline relative to horizontal 15 between the lower region 29 and upper region 31 of the magnetic separator apparatus 10 and through a separation zone 11 in which a magnetic field is created. A lower run 39 of the endless belt 20 moves in a descending manner between the upper region 31 and the lower region 29 of the magnetic separator apparatus 10. As shown in FIG. 1, the endless belt 20 is positioned about the rollers 14, 16 for continuous operation with return of the lower run 39 of the endless belt 20 after discharge of magnetic material via an opening or channel 88 in support structure 12.

Generally, according to the present invention, the support structure 12 includes elements for use in positioning at least a portion of the endless belt 20 which is movable through the separation zone 11 at an incline preferably of about 1° to about 75° relative to horizontal 15. Preferably, the incline is of an angle in the range of about 10° to about 45°. Generally, the incline is measured as the angle of the base section 50 of endless belt 20 in the separation zone 11 relative to horizontal plane 15.

Two primary rollers, upper end roller 14 and lower end roller 16, are supported for rotation thereof by support structure 12. The upper end roller 14 and lower end roller 16 are fixed and separated by a predetermined distance. As shown in FIG. 2, upper end roller 14 is affixed to axle 80 with longitudinal axis 72 extending therethrough. Axle 80 is coupled to structure 12 at coupling regions 260 and 261 allowing for rotation of the upper end roller 14 about longitudinal axis 72. End 263 of axle 80 is connected for rotation thereof by drive pulley device 68.

Drive control platform 60 controls rotation of axle 80, and as such controls rotation of roller 14 which imparts movement to endless belt 20 up the incline relative to horizontal 15. Preferably, the belt is moved at a speed in the range of about 1 inch per second to about 10 inches per second. However, such speed will be dependant, at least in part, on the angle of incline and the percent of magnetic material in the mixture. The drive control platform 60 includes a controller 66 for controlling motor 62 and any other devices required for performing magnetic separation according to the present invention, e.g., feed source 26 for feeding a mixture of non-magnetic and magnetic material into channel 22 defined by endless belt 20, control of liquid source 28 for providing wash water into channel 22, etc. Motor 62 imparts rotation or motion to drive pulley device 68 via reducer 64 for driving roller 14.

Lower end roller 16, as shown in FIG. 2, includes an axle 82 extending along longitudinal axis 70 thereof. Axle 82 is coupled to structure 12 in regions 267 and 268 for allowing rotation thereof about longitudinal axis 70.

Lower end roller 16 includes an adjustment mechanism 84 for increasing or decreasing the distance between longitudinal axis 70 extending through lower end roller 16 and the longitudinal axis 72 extending through upper end roller 14. As such, adjustment mechanism 84 provides for adjustment of belt tension. Such an adjustment mechanism 84 may be provided by a slide and lock mechanism or by any other mechanism such as a counterweight or a take-up pulley.

The upper end roller 14, i.e., the drive roller, is mounted at an elevation from horizontal 15 which is greater than the elevation of lower end roller 16 to provide for the incline of the upper run 37 of endless belt 20. One skilled in the art will recognize that only a portion of the endless belt 20 may need to be inclined and that there may be other portions generally parallel to horizontal 15. However, at least a portion of the upper run 37 of the endless belt 20 which moves through the separation zone 11 must be at an incline to provide for flow of the mixture down the channel 22 defined by endless belt 20. Such an incline in the separation zone 11 provides for the mixture to flow counter to the movement of the endless belt 20 in the separation zone 11 as magnetic material is attracted to collection matrix 24 positioned in the channel 22 of the endless belt 20 which is moving through the separation zone 11 up the incline. For example, at lower region 29 of the endless belt 20 outside of the separation zone 11, a portion of the endless belt may be substantially parallel to horizontal 15.

Support structure 12 further includes elements for supporting hold down rollers 76, 77 which are positioned for holding down endless belt 20. Such rollers are preferably free to rotate as the endless belt 20 is moved up the incline. The hold down rollers 76, 77 maintain endless belt 20 within a particular path as it rotates around upper end roller 14 and lower end roller 16. Such positioning of endless belt 20 may also be accomplished using hold up rollers such as the dashed hold up roller 78 shown illustratively in FIG. 1. Further, a combination of hold down and hold up rollers may be used to provide for positioning of endless belt 20 as it moves up the incline relative to horizontal 15 and around rollers 14, 16.

Rollers 14 and 16 are adjustable perpendicularly or vertically relative to the inclined plane and as such relative to hold down rollers 76, 77 as shown by arrows 270. As shown in FIG. 1, both the upper end and lower end rollers 14 and 16 are supported at an elevation above hold down rollers 76, 77 (i.e., the outer edges of the rollers are a greater distance from the inclined plane than the hold down rollers 76, 77. For example, as shown in FIG. 1, a slight pooling effect is created by the elevation of the lower end roller 16 relative to the hold down rollers 76, e.g., a pool of the mixture may tend to form at the lower region 29 of the magnetic separator apparatus. However, if the elevation of the roller 16 is further increased relative to the position of the hold down rollers 76, an even larger pooling effect is created. Preferably, the roller 16 is positioned such that there is no pooling effect and the portion of the upper run 37 extending from the hold down rollers 77 to the end of the upper run at the lower region 29 is generally planar. Further, preferably, the roller 14 is positioned relative to the hold down rollers 77 such that the portion of the upper run 37 extending from the hold down rollers 77 to the end of the upper run 37 at the upper region 31 is at an ascending angle relative to the preferably planar portion of the upper run 37 extending from the hold down roller 77 to the lower region 29. In other words, the ascending angle may be in the range of about 5° to about 30 ° greater than the angle of incline of the endless base section 50 in the separation zone 11. The additional incline provided in the upper region 31 promotes drainage of water from the collected magnetic material collected by the ferromagnetic collection matrix 24.

Generally, the magnetic separator apparatus 10 according to the present invention may be configured in any manner using any type of support structure 12 for supporting at least a portion of the endless belt 20 at an incline in the separation zone 11, while allowing the rotation of endless belt 20 up the incline. The functions of the upper end roller 14 and lower end roller 16 may be provided by any elements which are suitable for maintaining at least a portion of the endless belt 20 at an inclined position in the separation zone 11 and for allowing movement of the endless belt 20 up the incline in the direction of arrows 17.

In FIG. 1, the arrows 17 also give the direction of rotation of rollers 14 and 16. A roller as used herein may include any curved surface at the lower region 29 and upper region 31 which allows for rotation of endless belt 20. For example, a roller as used herein may be an element having a curved surface which is in a fixed position. As such, the rollers 14, 16 may not be used for providing rotation of the endless belt 20 but a drive mechanism that mechanically moves the endless belt 20 about such fixed elements may be required. Further, if the rollers are fixed curved surfaces, the longitudinal axes 70, 72 would be longitudinal axes of a cylinder on which such curved surfaces would lie. The present invention contemplates the use of any components for moving the endless belt 20 up an incline relative to horizontal 15 and is in no manner limited to the illustrative components shown and/or described herein.

It will be recognized by one skilled in the art that the number of rollers about which the endless belt 20 moves may include rollers in addition to the upper end and lower end rollers 14, 16. For example, the endless belt 20 may rotate about an additional roller located at a position below the upper end and lower end rollers 14, 16, e.g., forming a triangular shaped endless belt when the belt is positioned about such rollers. Such an additional roller may be used to further provide additional belt tension or may provide any other desired functionality for the magnetic separator apparatus 10. However, preferably, the endless belt 20 is positioned for rotation around two rollers separated by a predetermined distance with one of the rollers positioned at a first distance above horizontal 15 which is greater than a distance between the other roller and horizontal 15 such that incline is provided.

Figure 3A:
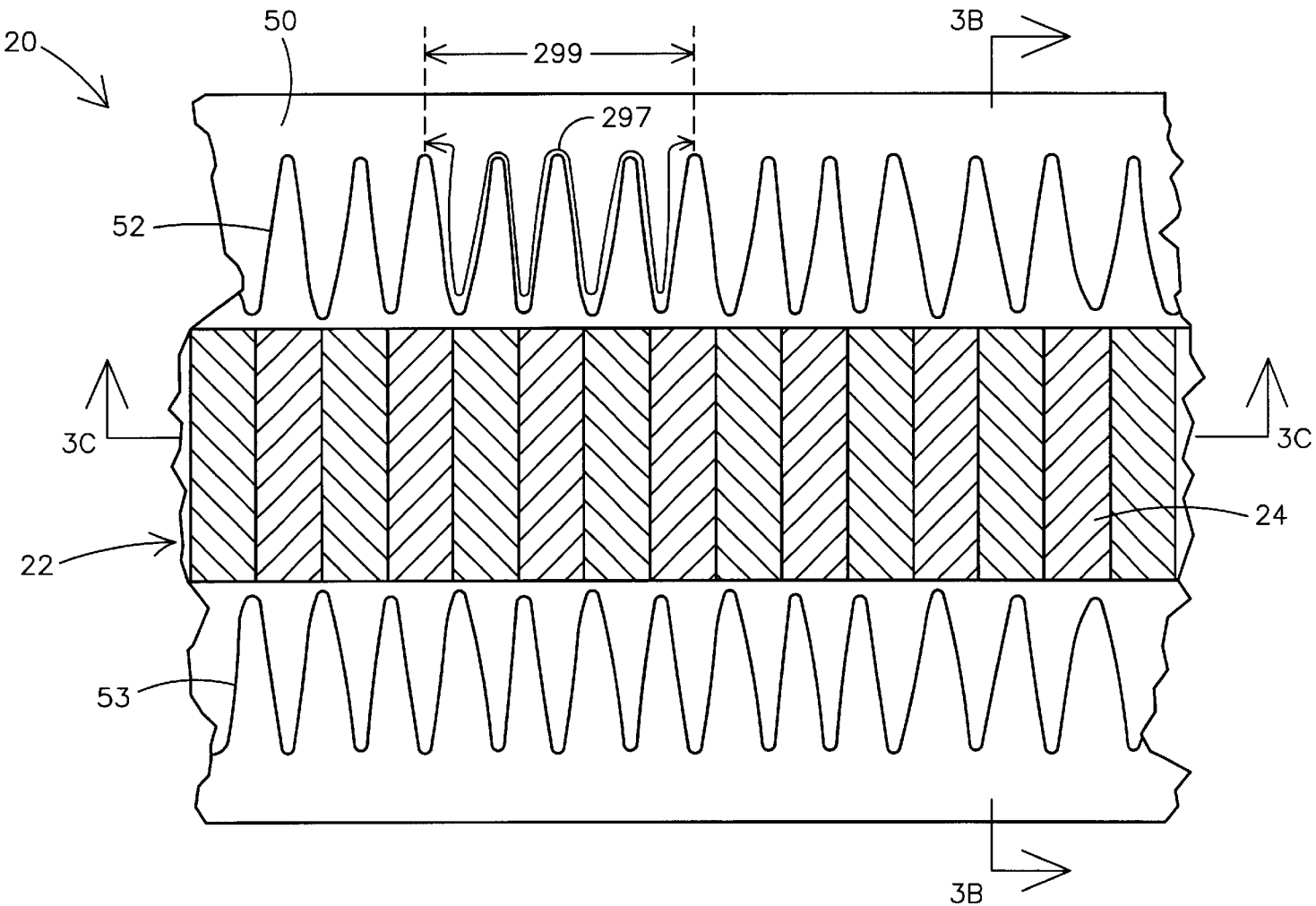
FIG. 3A is a more detailed top view of a portion of the endless belt of the magnetic separator apparatus shown in FIG. 1 having a particular collection matrix positioned in a channel defined thereby.
Figure 3B:
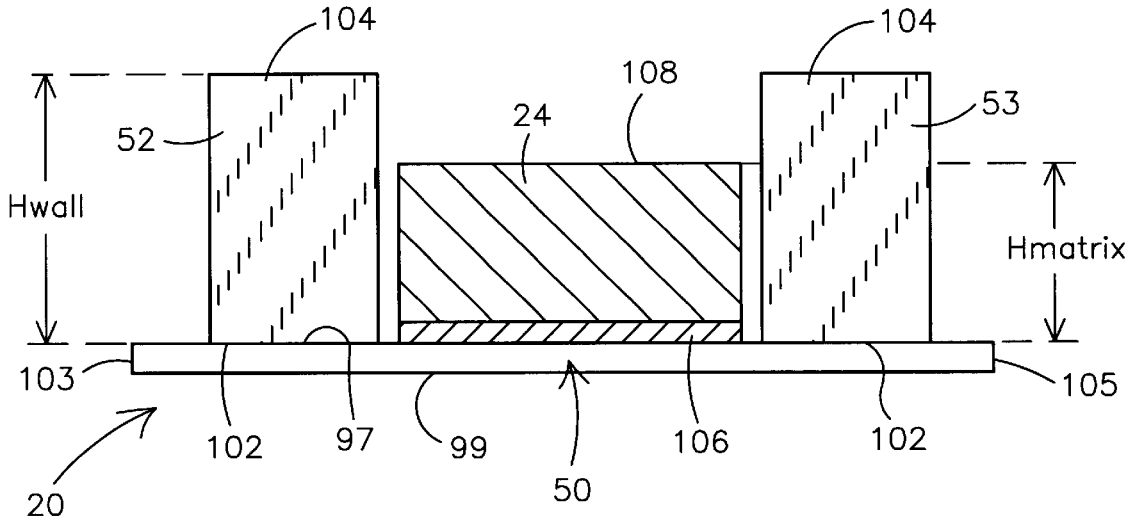
FIG. 3B is a cross-sectional view of the portion of the endless belt of FIG. 3A taken at line 3B—3B.
Figure 3C:
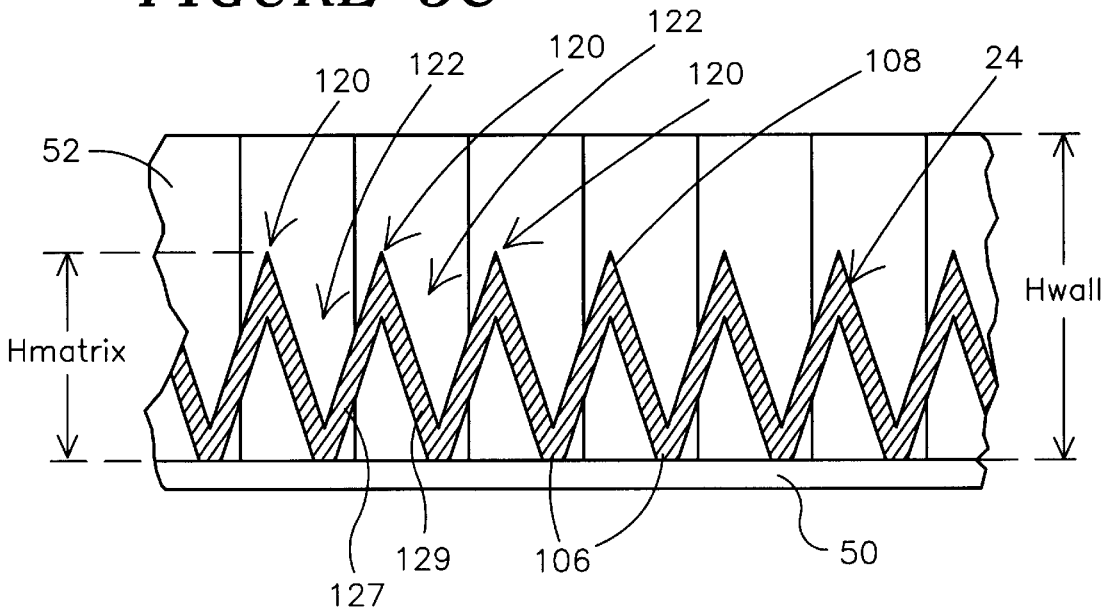
FIG. 3C is a cross-sectional view of the endless belt of FIG. 3A taken at line 3C—3C.

The endless belt 20 provided for rotation about rollers 14, 16 has one sidewall thereof cut-away in one particular section in FIG. 1 so as to show the channel 22 defined therethrough wherein ferromagnetic collection matrix 24 is positioned. FIGS. 3A–3C show the endless belt 20 in further detail. FIG. 3A is a detailed top view of a portion of the endless belt 20 of FIG. 1. FIG. 3B is a cross-section of the portion of the endless belt 20 taken along line 3B—3B of FIG. 3A, and FIG. 3C is a cross-section of the portion of endless belt 20 taken along line 3C—3C of FIG. 3A.

As shown in FIGS. 3A–3C, endless belt 20 includes a base section 50 having an upper major surface 97 and a lower major surface 99. The endless belt 20 further includes the two sidewalls 52, 53 extending from the upper major surface 97 of base section 50 to define channel 22 therebetween. The lower major surface 99 is for direct contact with the rollers 14, 16 as the endless belt 20 is rotated thereabout.

Generally, the endless belt 20 may include any configuration of a base section and sidewalls that would define a channel 22 for carrying ferromagnetic collection matrix 24 and which provides a channel having a depth sufficient for receiving and holding the mixture provided therein, e.g., a suspension provided from feed outlet 27 of feed source 26. One skilled in the art will recognize that any configuration for feed source 26 may be used to provide the feed mixture into channel 22.

Optionally, in addition to a mixture provided to channel 22 from feed source 26, a liquid, e.g., wash water, may further be provided into channel 22 from outlet 33 of liquid source 28. Such wash water would be provided upstream of the feed mixture such that the wash water runs down the incline to further aid in suspending the material of the feed mixture and in removing entrained non-magnetic material. For example, the liquid source 26 may be a wash water source such as a sprayer, a continuous flow apparatus, a pressurized flow apparatus, or any other liquid source suitable for providing a liquid into channel 22 for flow down the incline. It will be recognized by one skilled in the art that additional feed and wash stations could be provided along the length of the separation zone 11. It will be further recognized that the separation zone 11 could be divided into regions of varying degree of inclination, e.g., divided using additional rollers like hold down rollers 76, 77.

Preferably, the sidewalls 52, 53 are sufficiently high to cover the collection matrix 24 positioned within channel 22 with the mixture provided therein. As shown in FIG. 3B, sidewalls 52, 53 extend substantially vertically from the upper major surface 97 of endless base section 50. However, such sidewalls need not extend vertically from base section 50 but rather, for example, may extend at an angle relative thereto or take any other configuration, as long as a channel 22 is defined between the sidewalls 52, 53.

Generally, each sidewall 52, 53 includes a first proximal end 102 and a second distal end 104. The first proximal end 102 is sealed to upper major surface 97 of the base section 50 along the predetermined length of the endless base section 50. The sidewalls 52, 53 are flexible sidewalls. As used herein, flexible sidewalls refer to side walls which have an expanded length that is greater than its effective length. In other words, the sidewall's expanded length, i.e., the length of the sidewall if the sidewall were flattened into a plane of material (e.g., expanded length 297 along distal end 104), is less than the sidewall's effective length, i.e., the length along the direction of travel of belt 20 which is occupied by the sidewall (e.g., effective length 299). As such, the second distal end 104 of the sidewalls can be flexed to a length that exceeds the predetermined length of the endless belt base section 50 which is substantially the same length as the effective length of a sidewall 52, 53 because the sidewalls extend along the entire length of the base section 50. With such flexibility, as the endless belt 20 is moved over and around rollers 14, 16, the distal end 104 of the sidewalls 52, 53 is expandable to a state wherein damage to the sidewalls 52, 53 does not occur. This is particularly advantageous where high sidewalls are necessary for providing a desirable large volume of material to flow in channel 22. For example, preferably, such sidewalls have a height (Hwall) that is greater than about 4 inches. Further, preferably, such sidewalls have a height (Hwall) that is greater than about 8 inches. The height (Hwall) is measured perpendicularly from the base section 50 to the distal end 104 of the sidewalls 52, 53.

Although the sidewalls 52, 53 may be constructed as any flexible sidewalls which can be moved about the rollers 14, 16 without being damaged, preferably, the endless belt 20 includes corrugated sidewalls, as is clearly shown in the detailed top view of the endless belt 20 in FIG. 3A. As used herein, corrugated refers to a structure have multiple folds therein. Such folds may be creased folds, but are preferably, rolling folds such as shown in FIG. 3A. For example, such an endless belt with raised corrugated sidewalls is available from American Bulk Conveying (Murray Hill, N.J.) under the trade designation of Corra-Trough belting. For example, in one particular configuration, the endless belt 20 is 12 inches wide with a 5 inch high sidewall (Hwall). The number of folds in the corrugated structure may be preferably in the range of about 4 per foot to about 24 per foot. However, such folds may be of different sizes and the number of folds per unit length may vary along the sidewall. For example, various corrugated structures are shown in U.S. Pat. No. 4,109,784 to Hartmann entitled "Conveyor Belt With Corrugated Sidewalls," issued Aug. 29, 1978, entirely incorporated herein by reference. The corrugated structure provides additional turbulence to the mixture flowing down the incline of the upper run 37 of the endless belt 20 as the corrugation interrupts the mixture flowing along the edges of the channel 22.

As shown in FIGS. 3A and 3B, the sidewalls 52, 53 are inset from edges 103, 105, respectively. The region of base section 50 proximate the edges 103, 105 allows for use of hold down rollers 76, 77. However, as indicated previously, it is not required that a pool be created between hold down rollers 76, 77 using the elevation of upper end and lower end rollers 14, 16. As such, the hold down rollers 76, 77 may be eliminated. With elimination of the hold down rollers 76, 77, the sidewalls 52, 53 could be moved out towards the edges 103, 105, giving more effective separation width between the sidewalls 52, 53. Preferably, the width of the channel 22 is in the range of about 3 inches to about 12 feet. In one particular configuration, the width of channel 22 may be about 5 inches.

As shown in the cut-away section of FIG. 1, ferromagnetic collection matrix 24 is positioned in channel 22. One illustrative ferromagnetic collection matrix 24 is shown in FIG. 1 and in further detail in FIGS. 3A–3C. However, various different types of collection matrix configurations may be used and the present invention is not limited to only those listed herein.

Generally, the ferromagnetic collection matrix 24 provides multiple points to concentrate the magnetic field provided by the one or more magnets 30 shown in FIG. 1. The collection matrix 24 provides a field gradient required to attract and hold magnetic particles in channel 22 as the endless belt 20 is moving up the incline relative to horizontal 15. Preferably, the collection matrix 24 is open and porous to allow the free flow of the mixture through the collection matrix 24 to provide opportunities for the magnetic particles of the mixture within channel 22 held in suspension to pass close enough to the collection matrix 24 so as to be captured. The non-magnetic materials of the mixture remain in suspension and are discharged using the flow of liquid down the incline and over lower end roller 16 into nonmagnetic collection launder 38. Preferably, the ferromagnetic collection matrix 24 is firmly attached to the endless belt 20 so that it moves through the separation zone 11 wherein the magnetic field is generated by the one or more magnets 30 without slipping relative to the base section 50 of the belt 20. However, the collection matrix 24 must be flexible enough to pass over the upper and lower end rollers 14, 16 without permanent distortion, and preferably in a manner which fans open the collection matrix 24 into an expanded state as defined below.

The ferromagnetic collection matrix 24 includes a plurality of matrix elements, for example, formed of wire mesh such as expanded metal, wire mesh screen, knitted wires, vertical rods, horizontal rods, random or patterned configurations of wires or rods, or combinations thereof. Further, the collection matrix elements need not be permanently attached to the endless belt 20. For example, steel balls may be used, assuming that some provision is made for recovery and recycling of such balls as they fall from the upper region 31 where the magnetic material is collected in magnetic collection launder 36. Therefore, the physical configuration of the collection matrix is not restrictive and the collection matrix may include any number of collection matrix elements providing it meets the requirements for mixture penetration and free discharge of the magnetic and nonmagnetic material separated according to the present invention at the upper region 31 and lower region 29 of the magnetic separator apparatus 10.

The composition of the collection matrix 24 is generally of a ferromagnetic material with low magnetic remnance, i.e., a low magnetic attraction force when outside of the separation zone 11. For example, such materials may include iron, magnetic stainless steel, or galvanized steel. Preferably, the collection matrix composition is ferromagnetic stainless steel, which is typically identified by a number between 400 and 499. One would not use a common austenitic stainless steel, such as type 316, which is not ferromagnetic.

Figure 6A:
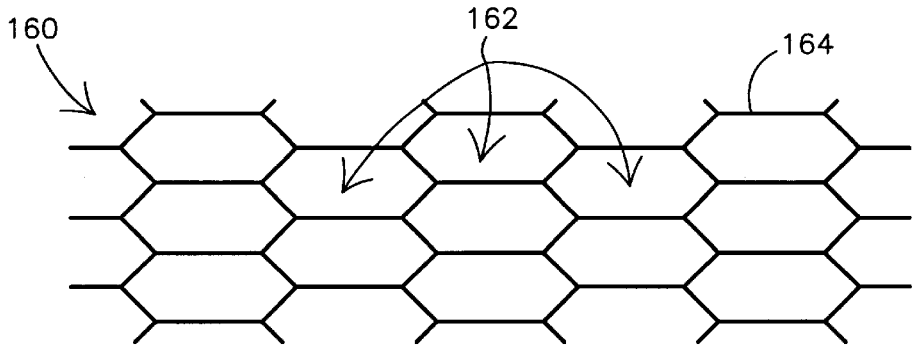
FIGS. 6A–6C show alternate materials for use in alternate illustrative collection matrices according to the present invention.
Figure 6B:
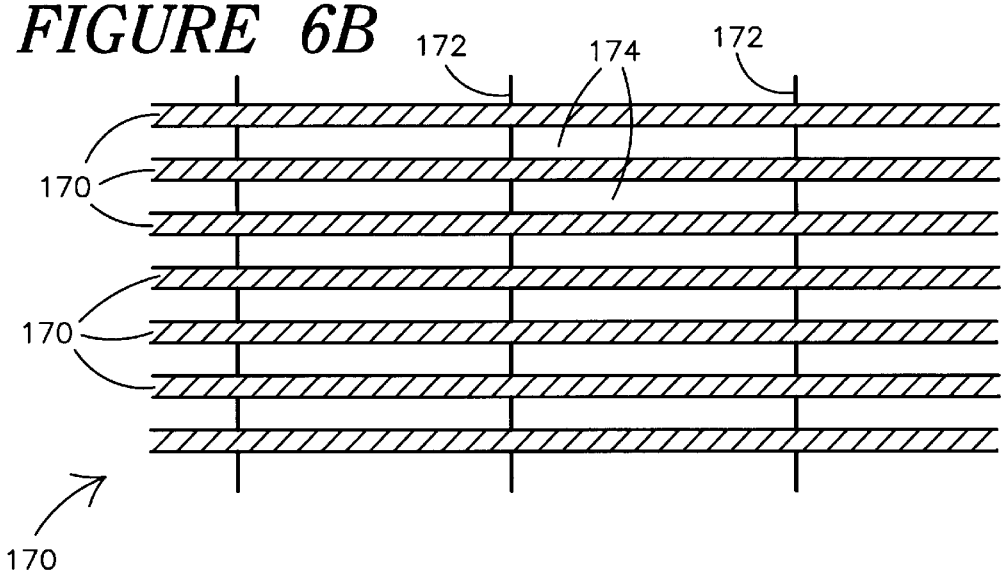

The ferromagnetic collection matrix 24 as shown in the cut-away section of FIG. 1 and in FIGS. 3A–3C includes an accordion folded collection matrix running the entire length of the channel 22 defined by the endless belt 20. The collection matrix 24 includes matrix elements 120, i.e., each single fold section of the matrix including folded portions 127 and 129, which extend in the direction of longitudinal axis 70 and 72 across the width of the channel 22, generally perpendicular to the travel of endless belt 20. More particularly, the collection matrix 24 is a folded expanded metal or wire mesh screen, such as those available from McMaster-Carr Supply Co. (Chicago, Ill.). For example, illustrative unfolded materials suitable for use in the collection matrix 24 according to the present invention are shown in FIGS. 6A and 6B. Preferably, the number of folds per foot along the channel 22 may be in the range of about 2 to about 50.

FIG. 6A shows an unfolded open collection matrix material 160. The unfolded open collection matrix material 160 includes hexagonal expanded metal structure 164 defining openings 162 therethrough. FIG. 6B shows an unfolded collection matrix material 170 wherein ferromagnetic separated rods 170 are held in position by metal elements 172, which may be non-magnetic, to define openings 174 for flow of material therethrough. It will be recognized that such materials may be folded in any number of manners. For example, the fold lines may be parallel to the rods 170 of FIG. 6B or may be perpendicular thereto. Parallel folds are preferred.

As shown in FIGS. 3A–3C, each of these unfolded materials shown in FIGS. 6A and 6B are capable of being folded into an accordion-like configuration to form collection matrix elements 120 extending generally perpendicular to the travel of endless belt 20 up the incline relative to horizontal 15. Each of these collection matrix elements 120 generally has a proximal end 106 adjacent base section 50 of endless belt 20 and a distal end 108, i.e., a fold line. Generally, the height of the collection matrix (Hmatrix), as shown in FIG. 3C and as measured by the perpendicular from the endless base section 50 to the distal end 108 of the collection matrix element 120, is generally equal to or less than the height (Hwall) of sidewalls 52, 53. Preferably, Hmatrix is less than Hwall. For example, if Hwall is 4 inches, Hmatrix may be 3 inches to provide splash tolerance.

Between adjacent collection matrix elements 120 are element gaps 122. The element gaps 122 between adjacent collection matrix elements 120 provide for assisting the discharge of magnetic material from the collection matrix elements 120 as the collection matrix 24 is move over upper end roller 14, e.g., allow for fanning open the collection matrix 24.

Figure 4:
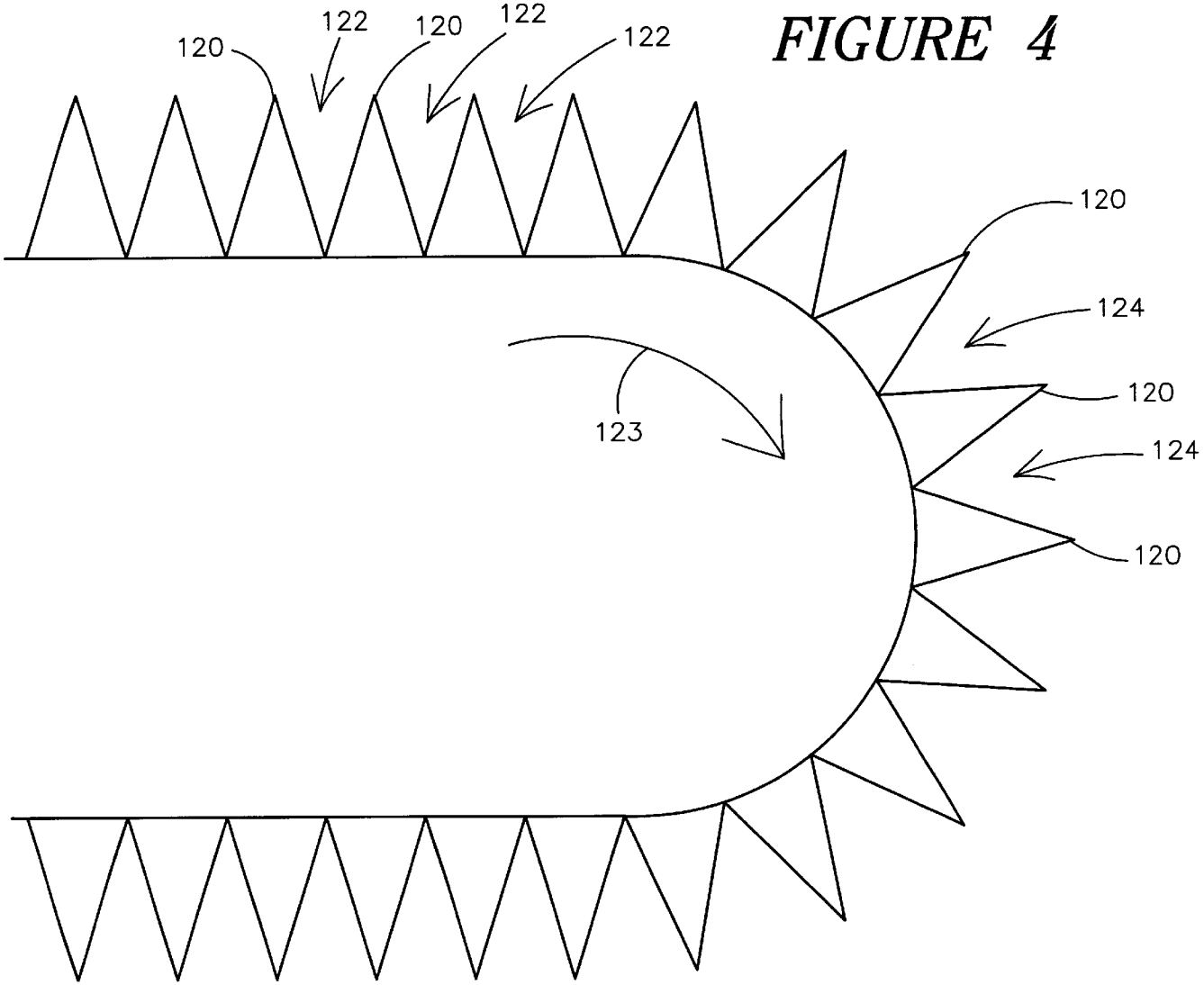
FIG. 4 is an illustrative diagram showing the expansion of gaps between matrix elements of a ferromagnetic collection matrix as the endless belt moves over a roller according to the present invention.

As shown in FIG. 4, this accordion-like structure of matrix elements 120, as well as other structures described herein, fans open as the collection matrix 24 is moved over rollers 14, 16 in direction 123. As used herein, fanning open of the collection matrix refers to the expansion of gaps 122 between adjacent collection matrix elements 120. For example, as shown in FIG. 4, the element gaps 122 when the endless belt is in a planer state are of a particular size. As the collection matrix elements move over a roller or curvature, the size of the element gaps 122 increase, as shown by the expanded element gaps 124. As the element gaps 122 expand into expanded element gaps 124, the collection matrix 24 opens itself up or fans open and provides a self-cleaning action such that material in the collection matrix 24 is discharged effectively. Further, the expanded element gaps 124 allow for material collected by the collection matrix 24 to be washed out using, for example, wash water available from a source such as source 32 shown in FIG. 1 at upper region 31 of the magnetic separator apparatus 10.

As described above, collection matrix elements may be single collection matrix elements extending across the width of channel 22, e.g., a folded collection matrix element 120 wherein the fold runs parallel to longitudinal axes 70, 72 of rollers 14, 16 and perpendicular to direction of travel of endless belt 20. However, a plurality of matrix elements across the width of the channel 22 may be used, as is shown in the illustrative embodiment of FIGS. 5A–5C.

Figure 5A:
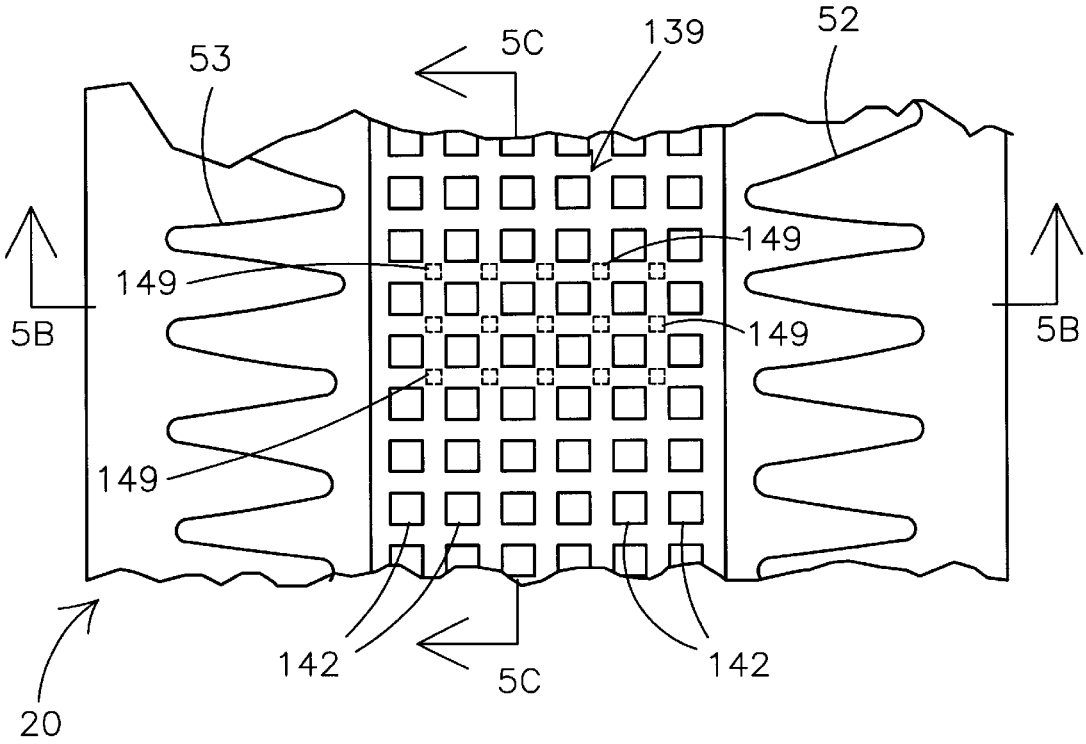
FIG. 5A is a more detailed view of a portion of the endless belt of FIG. 1 with an alternate ferromagnetic collection matrix positioned in the channel defined thereby.

FIG. 5A is a top view of the endless belt 20 including a collection matrix 139 positioned in channel 22 defined thereby. As shown in the cross-section view of FIG. 5B taken at line 5B—5B of FIG. 5A, the collection matrix 139 includes a collection matrix carrier 140 proximate the endless base section 50. The collection matrix carrier 140 includes a plurality of vertical collection matrix elements 142 positioned across the width of channel 22 extending from the collection matrix carrier 140. Adjacent vertical collection matrix elements 142 are separated by gaps 146 therebetween across the width of the channel 22.

Figure 5B:
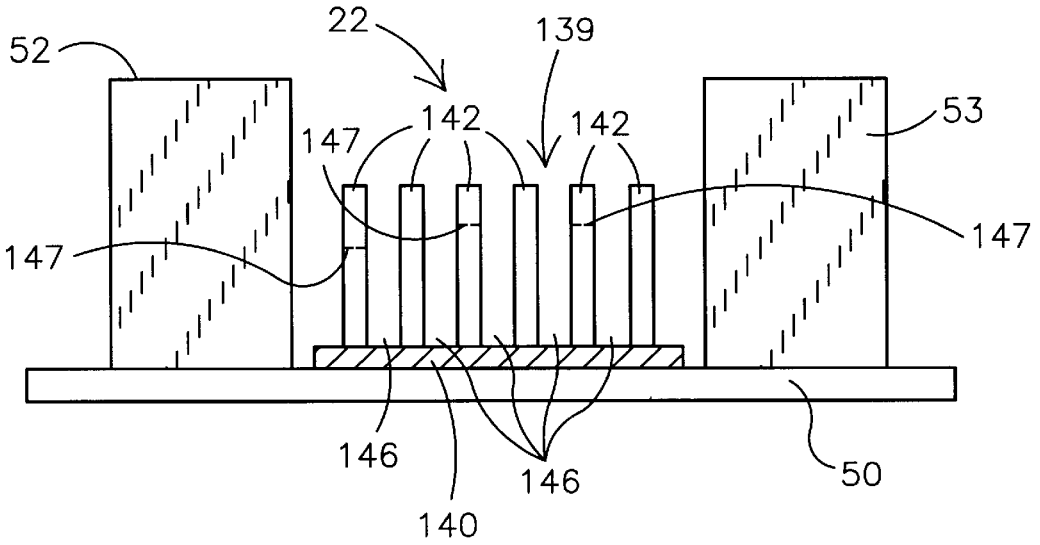
FIG. 5B is a cross-sectional view of the portion of the endless belt of FIG. 5A taken along line 5B—5B.
Figure 5C:
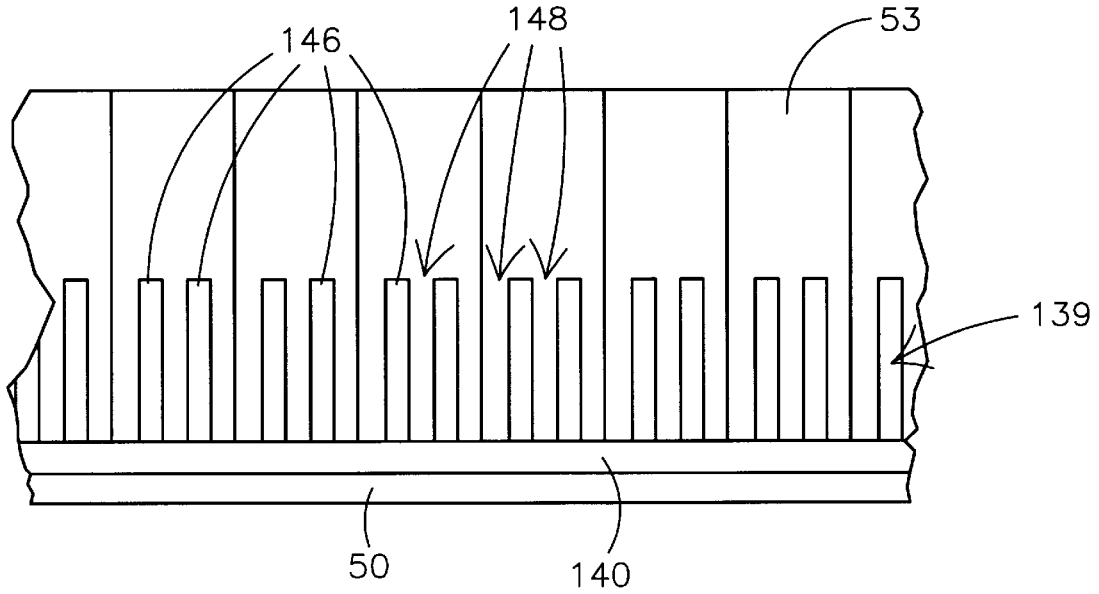
FIG. 5C is a cross sectional view of the portion of the endless belt of FIG. 5A taken along line 5C—5C.

FIG. 5C is a cross-section of FIG. 5A taken at line 5C—5C thereof. As shown in FIG. 5C, rows of such vertical collection matrix elements 142 extend along the predetermined length of the channel 22. The rows of collection matrix elements 142 are separated by element gaps 148. Like the element gaps 122 described above with reference to FIGS. 3A–3C, these gaps 148 are expanded as the collection matrix 139 is moved over roller 14 or other curvature to assist in discharge of material from the collection matrix 139.

Generally, the vertical collection matrix elements 142 are shown as peg-like structures or columnar-shaped elements extending from collection matrix carrier 140. However, FIGS. 5A–5C are provided to generalize the nature of the collection matrix configurations which may be used in accordance with the present invention. For example, any number of collection matrix elements may be used across the width of channel 22, and likewise, any number of collection matrix elements may be used along the predetermined length of channel 22. For example, in the embodiment of FIGS. 3A–3C, each collection matrix 120, i.e., a single matrix element, extends across the width of the channel 22 with a plurality of such collection matrix elements 120 extending along the predetermined length of the channel 22 defined by the endless belt 20. As shown in FIGS. 5A–5C, a plurality of collection matrix elements having gaps therebetween are positioned across the width of channel 22 as well as along the predetermined length of the channel 22.

Although the collection matrix elements 142 are shown as equal in vertical height within channel 22, they may vary in height as shown by the dashed lines 147 in FIG. 5B. Such dashed lines are indicative of a varied height for at least some of the vertical collection matrix elements 142.

Further, instead of a rectangular array of collection matrix elements 142, the matrix elements may be arranged in channel 22 in a staggered or offset configuration. For example, such an arrangement is illustrated in FIG. 5A by the addition of dashed lined matrix elements 149 which would be positioned along the entire channel in the pattern shown in FIG. 5A.

Yet further, such matrix elements in stead of being square in cross-section along the vertical height of such elements as shown in FIGS. 5A–5C, the matrix elements may have any cross-section. For example, the matrix elements may have a circular, triangular, hexagonal, or any other suitable cross-section.

Figure 6C:
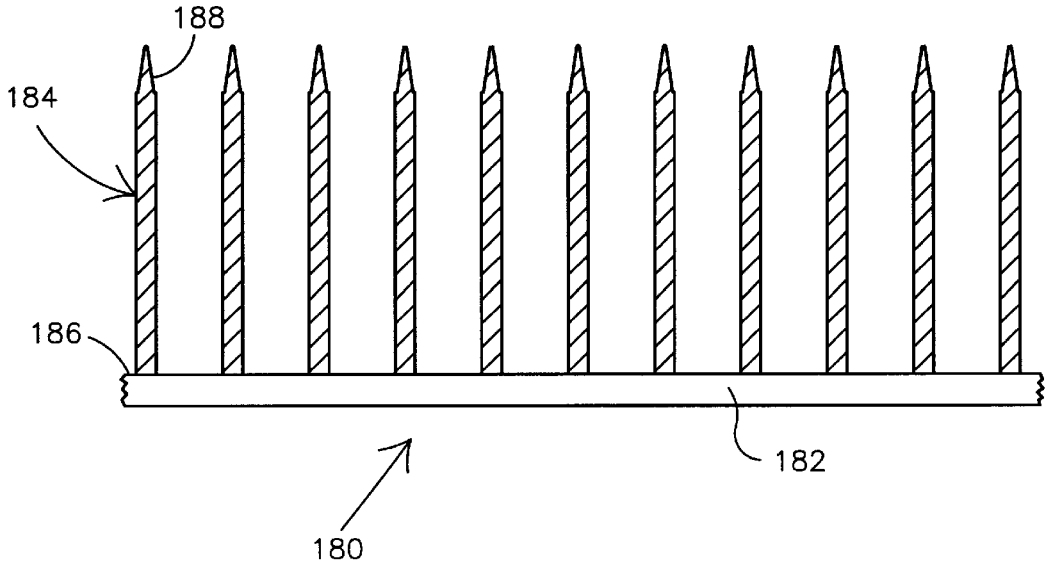

One particular configuration of vertical collection matrix elements is shown in FIG. 6C. As shown therein, the collection matrix 180 includes a carrier 182 having tapered projection elements 184 extending therefrom. Each of the tapered projection elements 184 includes a first proximal end 186 which may extend from or through carrier 182 and further which terminates in a pointed distal tip 188. For example, such collection matrix elements 184 may resemble spikes or nails.

Generally, the ferromagnetic collection matrix 24 is continuous in channel 22 over the entire length of the endless belt 20. The collection matrix 24 is energized by the magnetic field generated by the one or more magnets 30 in the separation zone 11 as the endless belt 20 passes through the separation zone 11. The magnetic material in the mixture of magnetic and non-magnetic material is attracted to and held to the collection matrix 24 and carried out of the separation zone 11 to be discharged over the roller 14 as a magnetic concentrate into magnetic collection launder 36. The non-magnetic material is carried by the water flowing counter to the travel of the endless belt 20 and the collection matrix 24. The non-magnetic material is discharged over the lower end roller 16 into non-magnetic collection launder 38.

The separation zone 11 as defined herein includes a volume in which a magnetic field is generated according to the present invention and through which the collection matrix 24 travels as the upper run 37 of the endless belt 20 moves up the incline. Further, generally, the mixture received in channel 22 flows down the incline through at least a part of the separation zone. The separation zone 11 shown in FIG. 1, is not shown to encompass the upper region 31 of the magnetic separator apparatus 10 nor the lower region 29. However, the separation zone 11, i.e., the zone in which a magnetic field is provided and through which the collection matrix 24 travels as the upper run 37 of the endless belt 20 moves up the incline, may be extended into such regions. For example, generally, the zone 11 may be extended to the highest vertical position of the upper run 37 of the endless belt 20 prior to descent of the belt 20; even the roller 14 may be magnetized. Further, for example, roller 16 may also be magnetized. The magnetic material discharge may take place anywhere from the point of descent of the upper run 37 at upper region 31 along lower run 39 provided it is performed in a near-zero field outside of the separation zone 11. Preferably, the separation zone 11 does not encompass the upper region 31 of the magnetic separator apparatus 10 as it is desired to move the collection matrix 24 out of the separation zone 11 having the magnetic field therein prior to fanning the collection matrix 24 open and discharging the magnetic material as the endless belt 20 moves over roller 14.

The magnetic field in the separation zone 11 may be generated in one of various manners. For example, the magnetic field may be provided by permanent magnets or the magnetic field may be provided by electromagnets. In the illustrative embodiment as shown in FIG. 1, the magnetic field generated in the separation zone 11, e.g., the region proximate the endless base section 50 where the ferromagnetic collection matrix 24 travels, is provided by permanent magnets as shown in FIGS. 7A–7B and FIGS. 8A–8C.

Figure 7A:
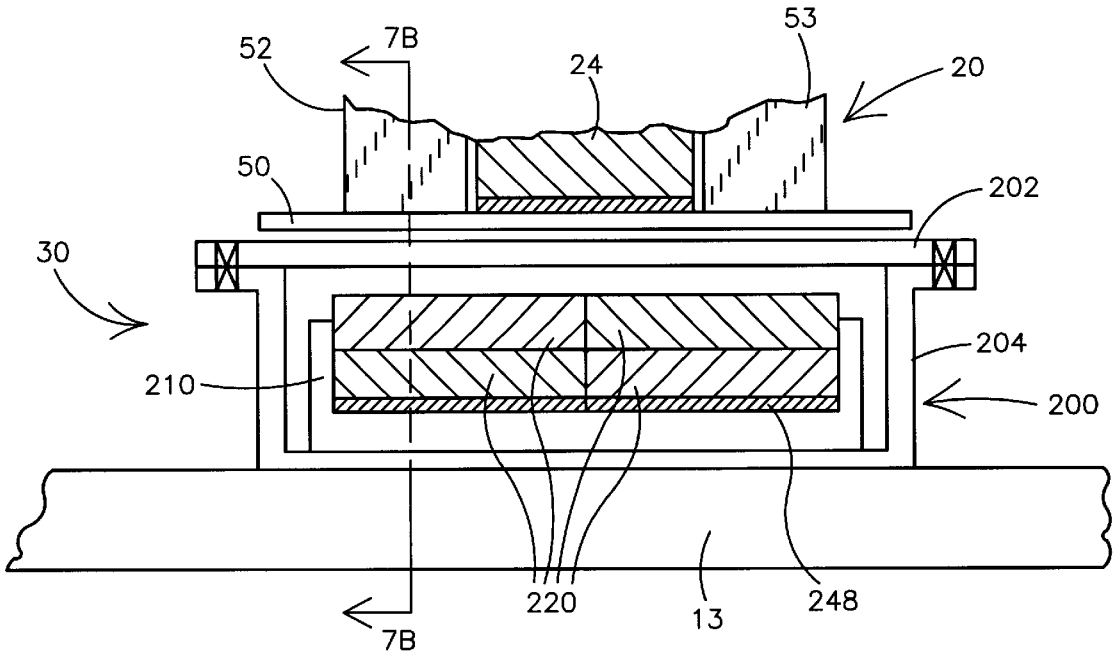
FIG. 7A is a cross-sectional view of the magnetic separator apparatus of FIG. 2 taken along line 7A—7A showing one illustrative embodiment of the one or more magnets used for generating the magnetic field according to the present invention.

As shown in FIG. 7A, which is a cross-section taken at line 7A–7A of a portion of the magnetic separator apparatus 10 shown in FIG. 2, permanent magnets 220 are mounted on a steel plate 248 in a water tight carrier tray 200 which is installed between rollers 14 and 16 just underneath the lower major surface 99 of the base section 50 of the upper run 37 of the endless belt 20 moving up the incline relative to horizontal 15. However, various configurations for permanent magnets may be used. For example, an alternate location for the permanent magnet tray may be above the portion of the upper run 37 of belt 20 moving up the incline, as opposed to below the upper run 37 of the belt 20. Further, it is not necessary that the magnets be incorporated in a single tray as various trays may be utilized. For example, two permanent magnet trays, one above and one below the upper run 37 of endless belt 20, can be used. Alternatively, permanent magnet assemblies may be placed on either side of the sidewalls 52, 53. However, lateral placement is only generally only effective when applied to small belt widths, e.g., widths less than about one foot.

In addition, in place of the permanent magnets or as a supplement thereto, electromagnets can be used. Electromagnets may be preferred for generating high magnetic fields required for collection of very weakly magnetic materials. Self-contained electromagnet arrays can be mounted in the same locations used for permanent magnets. Alternatively, an iron-clad solenoid with windings in planes above and below the upper run 37 of the belt 20, similar to the design shown in U.S. Pat. No. 3,920,543 issued Nov. 18, 1975 to Marston, could be used. Yet further, an alternative is a flattened solenoid with windings that wrap around the upper run 37 of the belt 20. Any one of the above electromagnet alternatives could be wound with superconducting wire in place of conventional copper or aluminum wire, cable, or hollow tubing.

As described above, it is clear that the only requirement for the configuration of the one or more magnets 30 is that the one or more magnets 30 provide a magnetic field in the separation zone 1. Preferably, the magnetic field is generated in a region proximate the endless base section 50 of the upper run 37 of the endless belt 20 through which the ferromagnetic collection matrix 24 travels as the endless belt 20 is moved up the incline relative to horizontal 15. Therefore, the one or more magnets 30 of FIG. 1 are generally representative of numerous different configurations possible for providing such a magnetic field. The magnetic field, however, as described above, is preferably terminated prior to the magnetic material being discharged from the collection matrix 24 at the upper region 31 of the magnetic separator apparatus 10.

The type of magnet selected to be used for the magnetic separator apparatus 10 depends upon the magnetic field required. One skilled in the art will recognize that magnetization of the collection matrix elements will modify the magnetic field in the vicinity of the collection matrix elements. Typically, a field strength at least double the applied field is produced close to the collection matrix elements.

Strong ferromagnetic materials, such as magnetite and ferrosilicon, require modest applied magnetic fields for attraction thereof to the collection matrix. For example, such fields may be typically in the range of 100–1,000 gauss. Generally, such field strengths are most economically achieved with sintered ceramic permanent magnets made of strontium/barium hexaferrite. Polymer-bonded ceramic particle magnets may also be used. For more weakly magnetic materials, such as most natural hematites and ilmenites, applied fields in the range of 1,000–10,000 gauss are preferred. To provide such field strengths, typically either conventional electromagnets with iron pole pieces or high energy product permanent magnets are used. Common high energy product permanent magnets include neodymium-iron-boron, samarium-cobalt, and 2:17-type samarium-iron-cobalt. For weakly magnetic materials below about 10 microns in size, or for very weak magnetic materials such as pyrite and iron-bearing muscovite, applied fields in excess of 10,000 gauss allow collection at reasonably high flow velocities. Superconducting magnets may be preferred for such applications.

Within the separation zone 11, the applied magnetic field can be orientated in any possible direction and still be effectively used to energize the collection matrix 24 for attraction and collection of magnetic material. FIGS. 8A–8C and FIG. 9 show diagrams of two illustrative and alternate designs of permanent magnet arrays that may be used according to the present invention.

The magnetic array 228 is positioned with its center line 293 running parallel to the direction of travel of the endless belt 20 as shown in FIGS. 8A–8C and FIGS. 7A–7B. With regard to the magnetic array 228, the orientation of the magnetic field is directed upward over the center of a north pole, e.g., north pole 230, and then the magnetic field gradually turns and becomes parallel to the long axis of the magnet array (corresponding to the direction of travel of the endless belt 20) at a transition 290 between north pole 230 and south pole 231, e.g., transition 290. Then the magnetic field gradually turns downwards over the center of a south pole, e.g., south pole 231. When the endless base section 50 of the endless belt 20 is located within 2.5 inches of the center line 293 of the magnet array 228, the transverse component of the magnetic field (i.e., the component perpendicular to the direction of travel of the endless belt 20 and parallel to the longitudinal axes 70, 72) is negligible.

Figure 9:
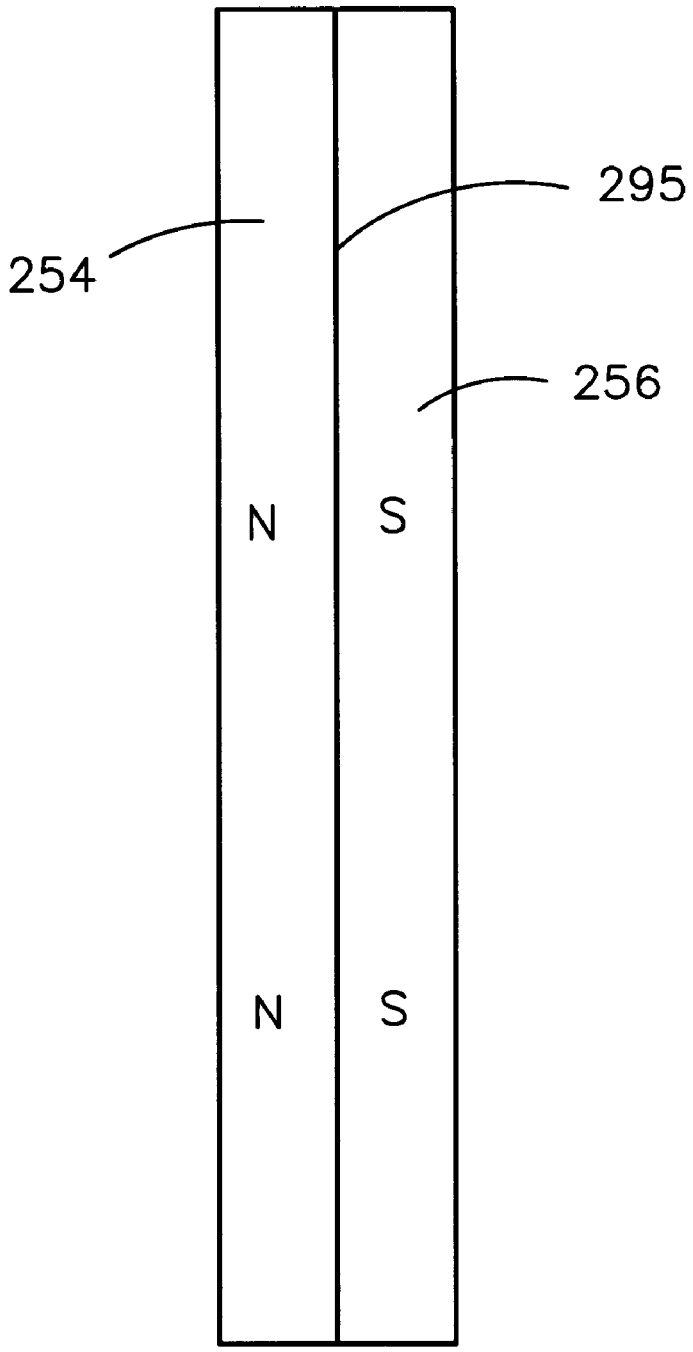
FIG. 9 is an alternate illustrative embodiment of a magnet array useable according to the present invention for providing a magnetic field in the separation zone of the magnetic separator of FIG. 1.

The magnet array 252 illustrated in FIG. 9 would be positioned in the magnetic separation apparatus 10 with its centerline transition 295 being parallel to the direction of travel of the endless belt 20. With regard to the magnet array 252, the direction of the magnetic field is transverse (i.e., perpendicular to the direction of travel of the belt 20 in the direction of the longitudinal axes 70, 72 of the rollers 16, 14) about the center line transition 295 from north pole 254 to south pole 256. On either side of the center line transition 295, the transverse field intensity decreases and perpendicular components (i.e., field components perpendicular to the direction of travel of the belt and also perpendicular to the plane defined by the moving belt itself) develop. The longitudinal components (i.e., components parallel to the direction of travel) are negligible.

Although either of the above illustrative permanent magnet configurations may be used, preferably, the magnet array 228 provides a more uniform separation environment and a uniform loading of the collection matrix 24 because the magnetic field does not vary significantly with lateral position on the endless belt 20 as it moves through the separation zone 11. Therefore, further description herein, for simplicity, is provided with respect to the permanent magnet array 228 shown in FIGS. 7A–7B and 8A–8C, even though various other array configurations may be used. As magnetic material is attracted and carried along by collection matrix elements of the collection matrix 24 in the direction of belt travel, e.g., up the incline relative to horizontal 15 in the separation zone 11, the direction of the magnetic field rotates as described above, i.e., upward over the north poles, parallel over the transition between north and south poles, and downward over the south poles, due to the alternating polarity of the permanent magnets positioned along the direction of belt travel. In response to the rotation of the magnetic field, the collected magnetic material migrates to new preferred collection sites on the collection matrix 24 as the belt 20 and collection matrix 24 travel through the separation zone 11. Such movement of magnetic material aids in the removal of physically entrained non-magnetic particles and will be described in further detail below. With respect to the magnet array 252 of FIG. 9, the field strength is high near the center line transition close to the face of the magnet array, leading to a tendency for particles to collect in thicker layers in this area of the collection matrix. Since the magnetic field remains the same in the direction of belt 20 travel and collected material has no tendency to reorientate, migration of magnetic material on the collection matrix 24 as described above with reference to magnetic array 228 does not generally occur.

Figure 8A:
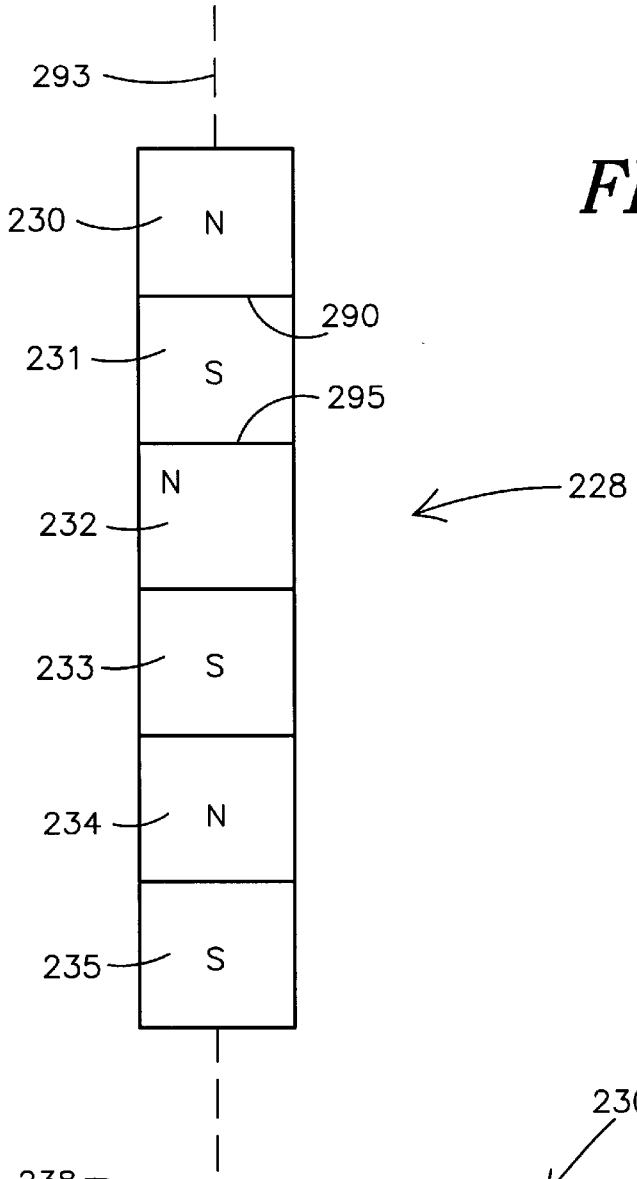
FIG. 8A is an illustrative diagram showing the alternating polarity of a magnet array used for creating the magnetic field in the separation zone of the magnetic separator of FIG. 1 according to the present invention.
Figure 8B:
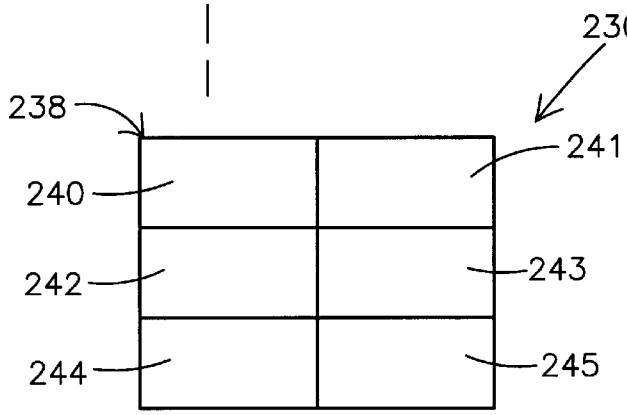
FIG. 8B is a more detailed view of one segment of the magnet array of FIG. 8A having a single polarity.
Figure 11A:
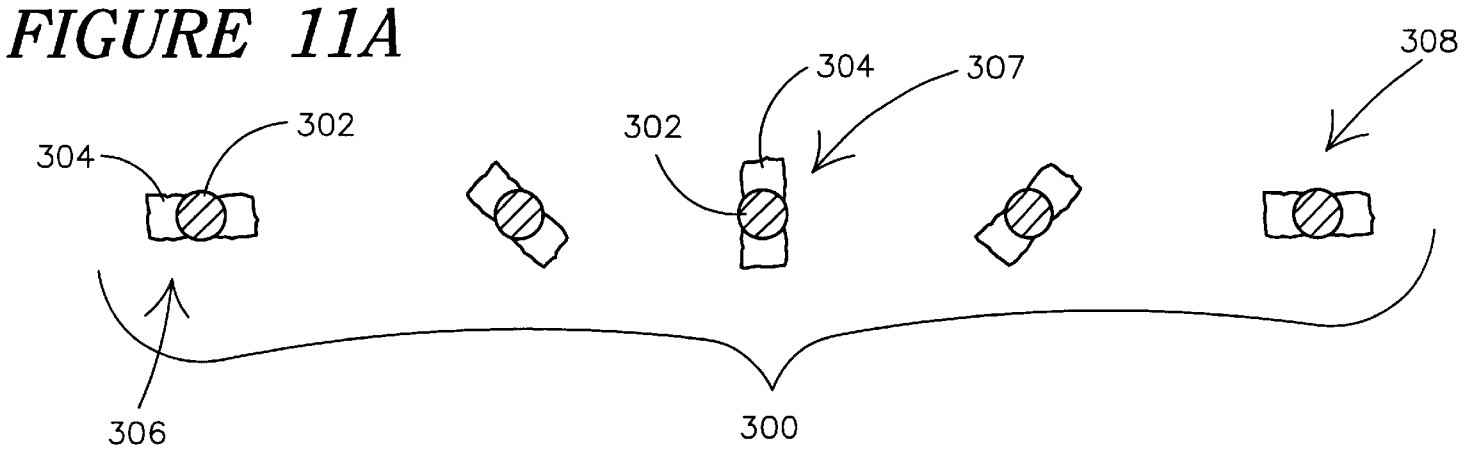
FIGS. 11A and 11B are illustrative diagrams showing matrix elements and the movement of collected magnetic material attracted to the matrix elements as the collection matrix travels through the alternating magnetic field in the separation zone according to the present invention.

The migration of magnetic particles on the collection matrix 24 with use of a rotating magnetic field provided by alternating poles of the permanent magnets of magnet array 228 shown in FIG. 8A, is further illustrated in FIG. 11A. For example, with respect to a collection matrix material of an expanded metal shown generally as metal material 302 in FIG. 11A, magnetic material 304 is shown attracted thereto. The metal material 302 is a piece of metal generally lying transverse in the channel 22, i.e., perpendicular to the direction of belt travel and generally in the direction of the longitudinal axes 70, 72. The migration sequence 300 shown in FIG. 11A shows the change in position of the magnetic material 304 as this illustrative piece of metal screen 302 moves through the separation zone 11 where a rotating magnetic field is generated by alternating polarities of permanent magnets 230–235. In FIG. 11A, the metal material 302 moves across a north pole to south pole transition, over a south pole, and then over a south pole to north pole transition. For example, the position of the magnetic material 304 when over each north pole to south pole transition (e.g., 290) is shown by reference numerals 306 and 308, i.e., the magnetic material 304 is at a particular position on metal material 302 when directly over such a transition. When the metal material is directly over a south pole, the magnetic material 304 is at a position as shown by reference numeral 307 which is generally opposite to that shown by reference numeral 306. At a south pole to north pole transition (e.g., 295), the magnetic material takes position 308 which is similar to position 306. In half of a complete field cycle, e.g., from a north pole to south pole, the magnetic material makes one complete revolution around a matrix material, e.g, metal 302.

Figure 11B:
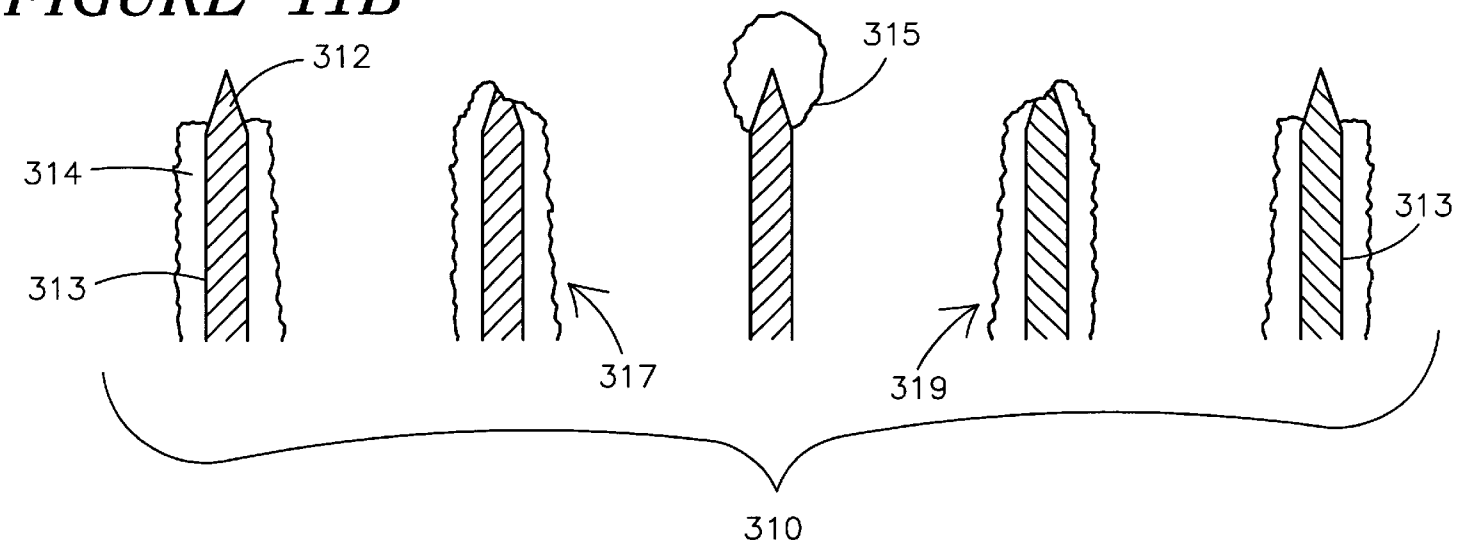

Further, for example, FIG. 11B shows the migration sequence 310 of magnetic material 314 on a spike-shaped matrix element 312 of a collection matrix as it is moved through the separation zone 11 having a rotating magnetic field generated therein. With regard to such a vertically extending element, the sequence 310 shows the magnetic material migration when the element 312 moves across a transition between north and south pole, over a south pole, and then over a south pole to north pole transition. As shown in FIG. 11B, the magnetic material 314 tends to migrate from a proximal position 313 of element 312 when the element 312 is over a transition to a distal position 315 of the element 312 when the spiked element 312 is over a south pole. As the element is passed from over a transition to over a pole, the magnetic material takes yet different positions on the spike element 312 as shown by the reference numerals 317 and 319.

Figure 7B:
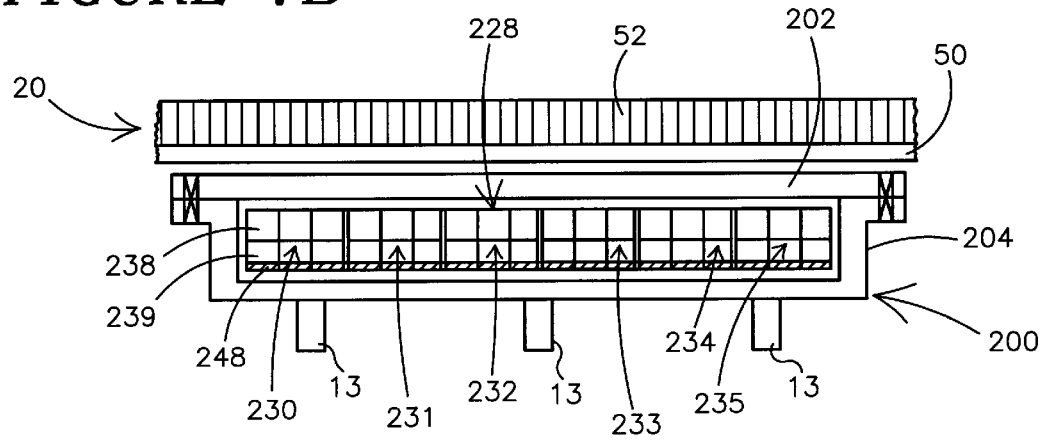
FIG. 7B is a cross-sectional view along line 7B—7B of FIG. 7A.
Figure 8C:
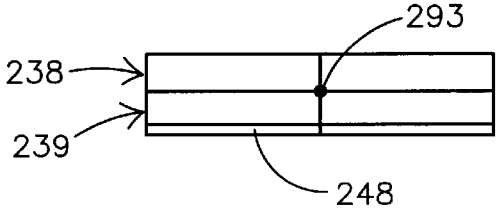
FIG. 8C is a side view of the magnet segment shown in FIG. 8B.

The illustrative magnetic array 228 as shown in FIGS. 8A and 7B generally includes six pole subassemblies 230–235. Such pole subassemblies 230–235 are shown in FIG. 7B as being positioned within carrier tray 200. One of the subassemblies 230–235 is shown in further detail in FIGS. 8B and 8C. Each subassembly 230–235 is made up of twelve 4×6×1 inch blocks of Ceramic 8 magnet material stacked two layers thick on a 12×12×0.5 inch base plate 248 of mild steel. For example, blocks 240–245 represent the top layer 238 of subassembly 230 with a similar bottom layer 239 being formed as shown in FIG. 8C. Ceramic 8 is a standard grade of oriented sintered strontium/barium ferrite with an energy product of about 3.5 MGOe. At room temperature, the remanent magnetization is about 3800 gauss and the intrinsic coercivity is about 3,000 oersteds. Each block of Ceramic 8 is magnetized, such as in an applied field of about 10,000 oersteds before being placed in the subassembly. Each block in a given subassembly 230–235 has the same orientation, e.g., either north pole upwards or north pole downwards. The blocks in each subassembly may be held in place and protected by a frame 210 (FIG. 7A) constructed of aluminum. A finished subassembly, for example, may have external dimensions of approximately 12.6×12.6×3.1 inches. In FIG. 7B, the six subassemblies 230–235 are shown in side-by-side configuration in the carrier tray 200 which includes an aluminum container portion 204 fitted with a waterproof plastic cover 202.

Figure 10A:
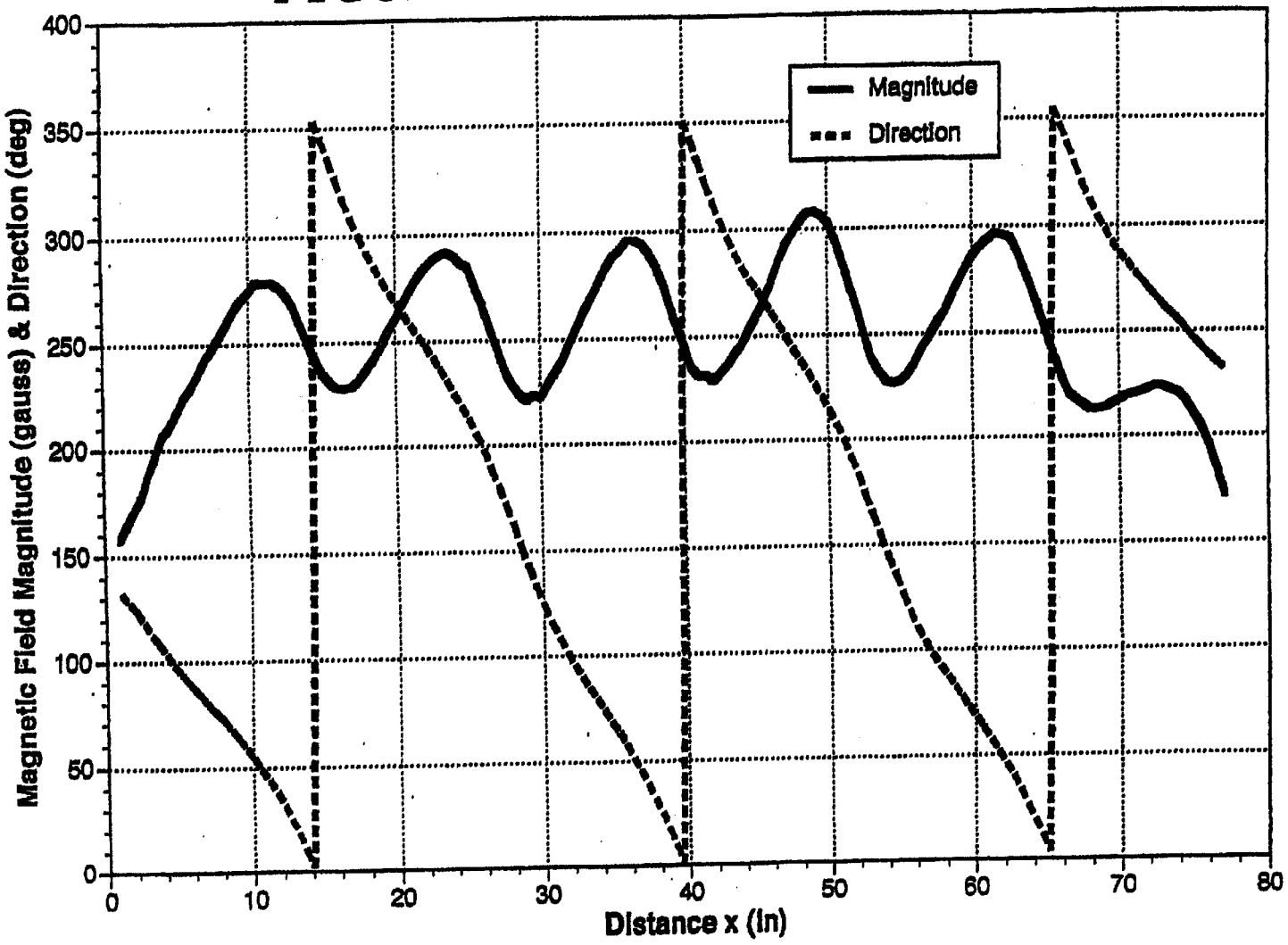
FIGS. 10A and 10B illustrate the magnetic field generated in the separation zone of the magnetic separator shown in FIG. 1.
Figure 10B:
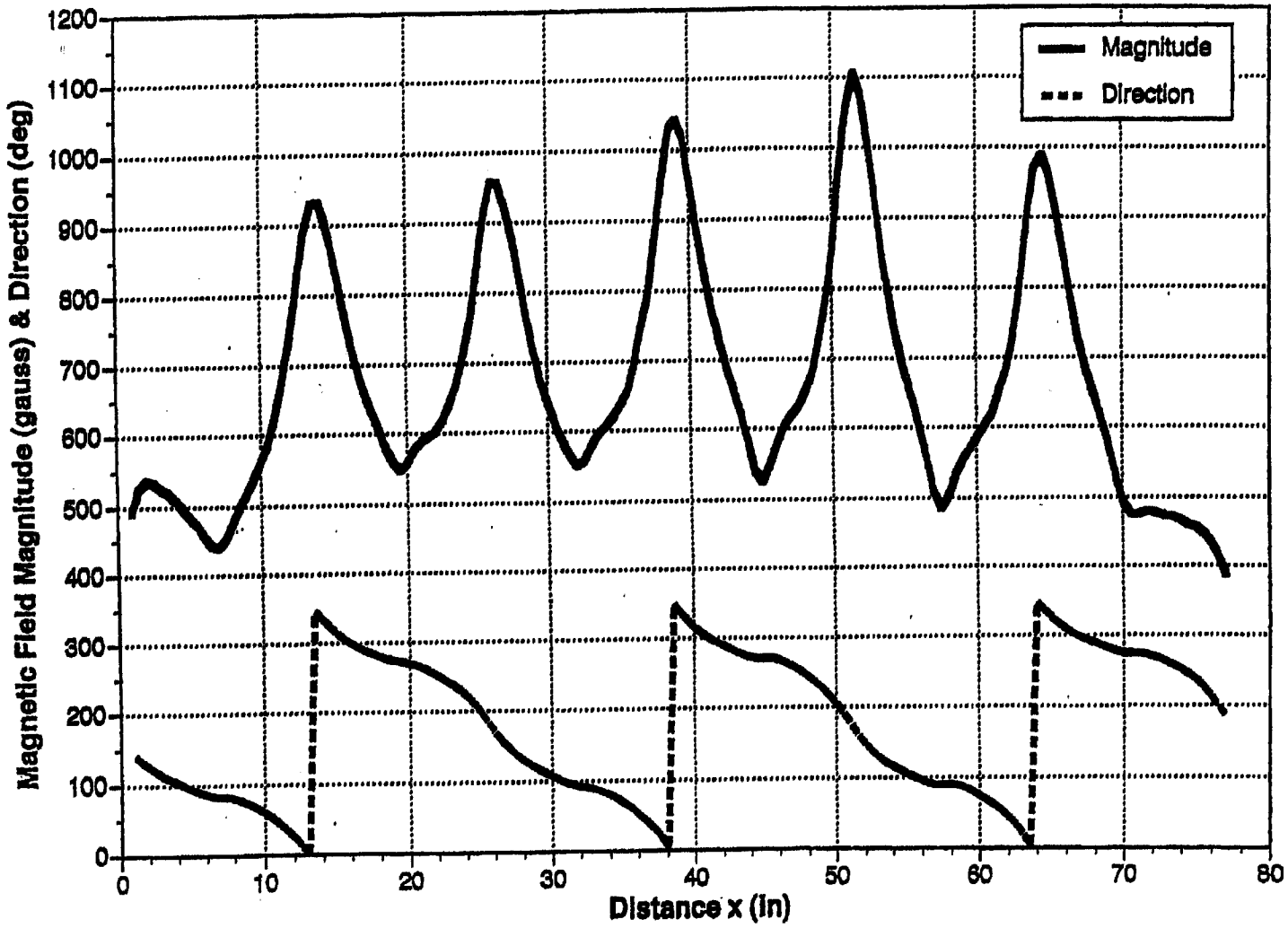

FIGS. 10A and 10B are graphs illustrating magnetic field profiles recorded using a Hall-effect gaussmeter at a couple of distances above the magnetic tray 200 holding the permanent magnet array 228 described above. The magnetic field profiles were recorded at distances of 0.5-inch and 4.0 inches above the cover 202 of the tray 200. The 0.5-inch distance, illustrated in FIG. 10A, corresponds approximately to the upper major surface 97 of the endless bases section 50 and the proximal end of portion of the collection matrix 24 positioned on the base section 50. The 4-inch distance, illustrated in FIG. 10B, corresponds generally to near the top of a collection matrix having a height (Hmatrix) of about 3.4–4.0 inches. The positive x-direction is taken to be down-slope in the direction of mixture flow, which is opposite to the direction of belt travel. In each graph, the magnitude of the magnetic field and its direction is shown. An angle of 0° corresponds to the positive x-direction, 90° as vertically upwards, 180° as in the direction of belt travel, and 270° as vertically downwards. It can be seen that as the collection matrix 24 moves through the separation zone 11 in the direction of belt travel, the direction of the magnetic field, to which the collection matrix 24 is exposed, rotates. In response, the collected magnetic material migrates around the collection matrix elements as described previously with regard to FIGS. 11A–11B. The movement of the collected magnetic material on the collection matrix 24 promotes the removal of the physically entrained non-magnetic particles such that they can be discharged downstream.

Generally, in accordance with the method of separation using the magnetic separation apparatus 10 as shown in FIG. 1, a mixture, e.g., a slurry of magnetic and non-magnetic material, is provided within the channel 22 along the upper run 37 of the endless belt 20. For example, a volume of mixture in the range of about 40 gallons per minute to about 1000 gallons per minute per square foot of channel cross-section may be provided for the separation of magnetite from taconite. The mixture flows down the incline counter to the direction of travel of the belt 20. The flow down the incline provides the magnetic material uniformly for attraction to and to be captured by the ferromagnetic collection matrix 24 as the endless belt 20 is moved up the incline through the separation zone 11 where the magnetic field is generated. Preferably, a rotating magnetic field in the separation zone 11 provides for migration of the magnetic material on the collection matrix 24 as the matrix moves past alternating poles of the permanent magnets used to generate the magnetic field in the separation zone 11. The magnetic material attracted to the collection matrix 24 is moved out of the separation zone 11 with the non-magnetic material in the mixture being moved downstream and over roller 16 into the nonmagnetic collection launder 38. The belt 20 carrying the collected magnetic material in the collection matrix 24 is moved beyond the separation zone 11 in which the magnetic field is being generated. With the magnetic material being carried beyond the separation zone 11 by the collection matrix because of the mechanical entrapment aided by the magnetic aggregation of the magnetic material, the magnetic material is then preferably provided for discharge at upper region 31 over roller 14. The magnetic material discharges at the roller 14 as the collection matrix 24 is fanned open as previously described herein, such as with reference to FIG. 4. Wash water may be provided by source 32 to assist in discharge of such magnetic material.

All patents and references disclosed herein are incorporated by reference in their entirety, as if individually incorporated. The preceding specific embodiments are illustrative of the practice of the present invention. It is to be understood, therefore, that other expedients known to those skilled in the art or disclosed herein may be employed without departing from the invention or the scope of the appended claims. For example, the present invention is not limited to the use of a particular collection matrix or magnet array configuration. The present invention is also not limited to use in connection with any particular mixture but finds general application with respect to the separation of magnetic material and non-magnetic material. Further, the present invention includes within its scope various methods of making and using the apparatus according to the present invention.

What is claimed is:

1. A magnetic separator apparatus for use in separating magnetic material from a mixture of at least magnetic material and a liquid, the apparatus comprising:

an endless belt defining a channel, wherein at least a portion of the endless belt is movable up an incline relative to horizontal between a first and second element through a separation zone, wherein the first and second elements include a first and second roller positioned with a fixed distance therebetween, wherein each of the first and second rollers has a longitudinal axis therethrough, wherein one of the first and second rollers is positioned at a first distance above horizontal and the other of the first and second rollers is positioned above horizontal at a second distance which is greater than the first distance, and further wherein the endless belt is positioned for movement about the first and second rollers up the incline in a direction perpendicular to the longitudinal axes of the first and second rollers, wherein the endless belt includes:

an endless base section having a predetermined length, and first and second sidewalls extending from the endless base section along the entire predetermined length thereof, wherein the endless base section and the first and second sidewalls define the channel, wherein each of the first and second sidewalls include a first proximal end sealed to the base section along the predetermined length and a second distal end, wherein the first and second sidewalls are flexible corrugated sidewalls such that the second distal end is expandable to a length that exceeds the predetermined length of the base section, and further wherein the channel receives the mixture therein;

a ferromagnetic collection matrix positioned in the channel, wherein the ferromagnetic collection matrix includes a plurality of collection matrix elements provided in a predetermined pattern along the base section of the endless belt such that the collection matrix elements are in a first state when the collection matrix elements are in a position away from at least one of the first and second elements and are in a second expanded state when proximate the at least one of the first and second elements, wherein the predetermined pattern includes two or more rows of one or more collection matrix elements, each row extending in the direction of the longitudinal axes of the rollers across a width of the channel between the first and second sidewalls, wherein adjacent rows of one or more collection matrix elements have element gaps defined therebetween, and further wherein the plurality of collection matrix elements are provided by an accordion-like folded collection matrix; and one or more magnets positioned for generating a magnetic field in the separation zone, wherein the one or more magnets include a plurality of magnets such that regions of alternating magnetic field are created in the separation zone through with the ferromagnetic collection matrix is moved.

2. The apparatus of claim 1, wherein the mixture is a suspension of non-magnetic and magnetic material.

3. The apparatus of claim 1, wherein the first and second sidewalls of the endless belt extend from the base section of the endless belt a predetermined distance measured perpendicularly from the base section to a distal end of the first and second sidewalls, and further wherein the predetermined distance is greater than about 4 inches.

4. The apparatus of claim 3, wherein the predetermined distance is greater than about 8 inches.

5. The apparatus of claim 3, wherein each collection matrix element extends from the base section a vertical distance measured perpendicularly from the base section to a distal end thereof, and further wherein the vertical distance is less than or equal to the predetermined distance which the first and second sidewalls extend from the base section.

6. The apparatus of claim 1, wherein the collection matrix elements are attached to the base section of the endless belt.

7. The apparatus of claim 1, wherein the plurality of collection matrix elements include folded metal mesh screen positioned in the channel, the fold lines of the folded metal mesh extending in the direction of the longitudinal axes of the rollers across a width of the channel between the first and second sidewalls.

8. The apparatus of claim 1, wherein each row of the one or more collection matrix elements is a single element extending in the direction of the longitudinal axes of the rollers across a width of the channel between the first and second sidewalls.

9. The apparatus of claim 1, wherein the one or more magnets include one or more electromagnets.

10. The apparatus of claim 1, wherein the one or more magnets include one or more permanent magnets.

11. A method for use in separating magnetic material from a mixture including at least magnetic material and a liquid, the method comprising:

moving a portion of an endless belt between a first element and second element up an incline through a separation zone, wherein the second element is elevated relative to the first element, wherein the endless belt includes an endless base section having a predetermined length and first and second sidewalls extending from the endless base section along the predetermined length thereof, wherein the endless base section and the first and second sidewalls define a channel, wherein each of the first and second sidewalls includes a first proximal end sealed to the base section along the predetermined length and a second distal end, wherein each of the first and second sidewalls are corrugated sidewalls, wherein moving the endless belt up the incline includes expanding each of the first and second sidewalls proximate at least one of the first and second elements such that the second distal end is of a length that exceeds the predetermined length of the endless base section, and further wherein a ferromagnetic collection matrix is positioned in the channel, the ferromagnetic collection matrix including a plurality of collection matrix elements provided in a predetermined pattern along the base section of the endless belt, wherein the predetermined pattern includes two or more rows of matrix elements, wherein each row extends across a width of the channel between the first and second sidewalls perpendicular to the direction of movement of the endless belt up the incline, wherein each row includes one or more collection matrix elements, wherein adjacent rows of the one or more collection matrix elements have element gaps defined therebetween when the collection matrix elements are in a position away from the second element, and further wherein the plurality of collection matrix elements are provided by an accordion-like folded collection matrix;

receiving the mixture including at least magnetic material within the channel for flow down the incline;

providing a magnetic field in the separation zone to magnetize the ferromagnetic collection matrix as the ferromagnetic collection matrix moves through the separation zone to attract magnetic material to the ferromagnetic collection matrix, wherein providing the magnetic field includes providing an alternating magnetic field along at least a portion of the separation zone such that attracted magnetic material migrates upon the ferromagnetic collection matrix as the endless belt is moved up the incline; and discharging magnetic material from the ferromagnetic collection matrix after the endless belt moves out of the separation zone, wherein discharging magnetic material includes fanning open the plurality of collection matrix elements and as such expanding the element gaps as the collection matrix elements are moved proximate the second element.

12. The method of claim 11, wherein the first and second sidewalls of the endless belt extend from the base section of the endless belt a predetermined distance measured perpendicularly from the base section to a distal end of the first and second sidewalls, and further wherein the predetermined distance is greater than about 4 inches.

13. The method of claim 12, wherein the ferromagnetic collection matrix includes a plurality of collection matrix elements, each of the collection matrix elements extending from the base section a vertical distance measured perpendicularly from the base section to a distal end thereof, and further wherein the vertical distance is less than or equal to the predetermined distance which the first and second sidewalls extend from the base section.

14. The method of claim 11, wherein each row of one or more collection matrix elements is a single element positioned across the width of the channel.

* * * * *